US009955534B2

(12) United States Patent
Galati

(10) Patent No.: US 9,955,534 B2
(45) Date of Patent: Apr. 24, 2018

(54) MICROWAVE TRAY AND ACCESSORIES

(71) Applicant: Chad Galati, Trabuco Canyon, CA (US)

(72) Inventor: Chad Galati, Trabuco Canyon, CA (US)

(73) Assignee: CK INNOVATIVE MICROWAVE PRODUCTS LLC, Trabuco Canyon, CA (US)

( * ) Notice: Subject to any disclaimer, the term of this patent is extended or adjusted under 35 U.S.C. 154(b) by 0 days.

(21) Appl. No.: 15/153,078

(22) Filed: May 12, 2016

(65) Prior Publication Data

US 2016/0338155 A1 Nov. 17, 2016

Related U.S. Application Data

(60) Provisional application No. 62/162,322, filed on May 15, 2015, provisional application No. 62/162,513, filed on May 15, 2015.

(51) Int. Cl.
*H05B 6/64* (2006.01)
*H05B 6/78* (2006.01)

(52) U.S. Cl.
CPC ..... *H05B 6/6411* (2013.01)

(58) Field of Classification Search
CPC ..... H05B 6/6411
USPC ..... 219/679, 754, 752, 751, 726, 738, 756, 219/757, 683, 734, 753, 762, 755, 746, 219/748; 366/274
See application file for complete search history.

(56) References Cited

U.S. PATENT DOCUMENTS

| | | | |
|---|---|---|---|
| 4,286,133 | A | 8/1981 | Einset et al. |
| 4,591,682 | A | 5/1986 | Takeuji |
| 4,701,585 | A | 10/1987 | Stewart |
| 4,714,813 | A | 12/1987 | Trenchard |
| 4,800,246 | A | 1/1989 | Lee et al. |
| 4,801,774 | A | 1/1989 | Hart |
| 4,892,213 | A | 1/1990 | Mason, Jr. |
| 4,939,332 | A | 7/1990 | Hahn |
| 5,151,569 | A | 9/1992 | Suh |

(Continued)

FOREIGN PATENT DOCUMENTS

| | | | |
|---|---|---|---|
| EP | 0609138 | A1 | 8/1994 |
| EP | 0849188 | A1 | 6/1998 |
| EP | 1348317 | B1 | 4/2006 |

OTHER PUBLICATIONS

Nordicware Cookware, https://www.nordicware.com/store/category/cookware#.V1uUovkrL1A, visited May 1, 2016.

(Continued)

*Primary Examiner* — Quang Van

(57) ABSTRACT

The present invention relates to microwave trays and microwave accessories for use in microwave ovens. A microwave tray includes an opening located near the center of the tray. The opening in the center of the tray provides access to a rotary coupling located on a bottom surface of a microwave oven. Various microwave accessories can be mounted on the tray using corresponding mating configurations included on the tray and the accessories. The microwave accessories are configured to perform dynamic functions (e.g., stirring, mixing, rotating and flipping) when the accessories are connected to the coupling and the microwave is powered on.

18 Claims, 22 Drawing Sheets

(56) References Cited

U.S. PATENT DOCUMENTS

| | | | | |
|---|---|---|---|---|
| D373,708 | S | 9/1996 | Hamilton et al. | |
| 5,593,609 | A | 1/1997 | Fletcher | |
| 5,786,580 | A | 7/1998 | Yeo | |
| D399,702 | S | 10/1998 | Mishan | |
| 5,877,479 | A | 3/1999 | Yu | |
| 6,076,957 | A | 6/2000 | Gomes | |
| D432,414 | S | 10/2000 | Simpson et al. | |
| 6,373,038 | B2 | 4/2002 | Han et al. | |
| D475,571 | S | 6/2003 | Hopkins | |
| D541,584 | S | 5/2007 | Lorbach | |
| D646,931 | S | 10/2011 | Chen et al. | |
| D690,984 | S | 10/2013 | Hauser | |
| D699,505 | S | 2/2014 | Kadva et al. | |
| D712,700 | S | 9/2014 | Bak | |
| 2004/0232142 | A1 | 6/2004 | Zhu | |
| 2004/0173606 | A1 | 9/2004 | Lindley et al. | |
| 2007/0007283 | A1* | 1/2007 | Kang | H05B 6/6411 219/754 |
| 2008/0083751 | A1 | 4/2008 | Berryhill et al. | |

OTHER PUBLICATIONS

VWR, "*Scienceware Microwave Magnetic Stirrer, Bel-Art*," https://us.vwr.com/store/catalog/product.jsp?product_id=4830707 visited on Jun. 11, 2016.

PCT Written Opinion and Search Report in PCT/US16/32333 dated Aug. 8, 2016.

* cited by examiner

MICROWAVE TRAY AND ACCESSORIES

CROSS-REFERENCE TO RELATED APPLICATIONS

The present application claims benefit of U.S. Provisional Application No. 62/162,322 filed on May 15, 2015 and U.S. Provisional Application No. 62/162,513 filed on May 15, 2015. Both of these applications are incorporated herein by reference in their entireties.

COPYRIGHT NOTICE

A portion of the disclosure of this patent document contains material, which is subject to copyright protection. The copyright owner has no objection to the facsimile reproduction by anyone of the patent document or the patent disclosure as it appears in the Patent and Trademark Office patent files or records, but otherwise reserves all copyright rights whatsoever.

FIELD OF THE INVENTION

The present principles are directed to systems, methods and apparatuses for cooking or heating items in microwave ovens, and more particularly, to improved microwave trays and accessories and methods of using the same to heat food products and other items.

BACKGROUND OF THE INVENTION

A microwave oven is a kitchen appliance that can heat food and other items by exposing them to radiation, such as microwave radiation. Many microwave ovens are equipped with trays (also referred to as turntables) that rotate the contents of the microwave while it is being heated. To enable the turntables to rotate, the microwaves include a motor that is connected to a coupling located on the floor of the microwave interior and which causes the coupling to rotate when the motor is powered on. A tray can be connected to the coupling and may rest on a support structure, e.g., such as a circular roller ring or a three-armed triangular support, that assists the tray with rotating.

Although microwave ovens heat food faster than wall ovens (e.g., gas or electric powered wall ovens), many individuals still prefer to cook food using wall ovens. This is because food that is cooked in wall ovens generally tastes better than food that is prepared in a microwave oven. This can be attributed, at least in part, to the fact that food which is prepared in a microwave oven is not always uniformly heated, thus resulting in "cold spots" in the food. The cold spots result from the manner in which the microwave ovens are manufactured, e.g., the manner in which radiation is emitted in a grid-like pattern in that creates "dead spots" inside of the microwave ovens where there are lower temperatures than other spots.

Another reason why individuals prefer wall ovens is because the process of cooking food in a microwave oven can be frustrating and tedious, as it often requires an individual to tend to the food during the cooking cycle. For example, an individual is often required to interrupt the cooking process in order to flip or rotate food being heated on a plate, and/or to stir or mix food that is being heated in a bowl. Therefore, cooking food in a microwave oven can be an aggravation and often results in food that does not taste as good as food that is cooked in a wall oven.

Despite the widespread use of microwave ovens for many decades in both residential and commercial environments, there has been very little improvement in terms of developing accessories for use in the microwave ovens. Most food is prepared in a microwave oven using plates, bowls or other cookware items. These cookware items do not assist individuals with cooking food within the microwave oven and, instead, require individuals to interrupt the cooking process to avoid cold spots in the food as explained above.

SUMMARY OF THE INVENTION

The inventive principles discussed herein relate to novel microwave trays and microwave accessories for use in microwave ovens. A microwave tray includes an opening located near the center of the tray. The opening in the center of the tray provides access to a rotary coupling located on a bottom surface of a microwave oven. A variety of different microwave accessories can be mounted on the tray near its opening and connected to the rotary coupling on the bottom surface of the microwave oven. The microwave accessories are configured to perform dynamic functions (e.g., stirring, mixing, rotating and flipping) for preparing food when the accessories are connected to the coupling and the microwave is turned on.

The microwave tray may be outfitted with a plug or cap accessory that enables rotation of the microwave tray. The bottom surface of the plug may include a coupling connector that is configured to engage the rotary coupling and a mating portion that is configured to mate with a corresponding mating portion of the microwave tray. When the plug is engaged with the coupling and the mating portion of the tray, the tray becomes rotatable. The upper surface of the plug may be substantially level so as to form a planar or flat surface that allows plates, cups, bowls or other items to be easily balanced atop the microwave tray.

In accordance with certain embodiments, a microwave assembly is provided for use in a microwave oven. The microwave assembly includes a microwave tray that has an opening located near its center and a first mating connector located near the opening. The microwave assembly further includes a microwave accessory. The microwave accessory includes a second mating connector located on a bottom portion of the microwave accessory. The first mating connector and second mating connector re configured to engage one another so as to mount the microwave accessory to the microwave tray. The microwave accessory further includes a coupling connector that is configured to engage a rotary coupling located on an interior floor of a microwave oven.

In accordance with certain embodiments, a microwave assembly is provided for use in a microwave oven. The microwave assembly includes a microwave tray that has an opening located near its center and a tray plug that is configured to be inserted into the opening. A bottom surface of the tray plug includes a coupling connector that is configured to engage a rotary coupling located inside of a microwave oven.

In accordance with certain embodiments, a method is provided for using a microwave assembly in a microwave oven. The method includes the step of providing a microwave tray that has an opening located near its center. The step of providing a microwave tray may include generating, fabricating, manufacturing, creating, or utilizing the microwave tray. The microwave tray includes a mating connector that enables a microwave accessory to be coupled to the microwave tray and the microwave accessory may include a coupling connector that is configured to engage a rotary coupling located inside of a microwave oven.

These and other features and advantages will become apparent from the following detailed description of illustrative embodiments thereof, which is to be read in connection with the accompanying drawings.

BRIEF DESCRIPTION OF DRAWINGS

The inventive principles are illustrated in the figures of the accompanying drawings which are meant to be exemplary and not limiting, in which like references are intended to refer to like or corresponding parts, and in which.

DETAILED DESCRIPTION OF THE EMBODIMENTS

Figure 1:
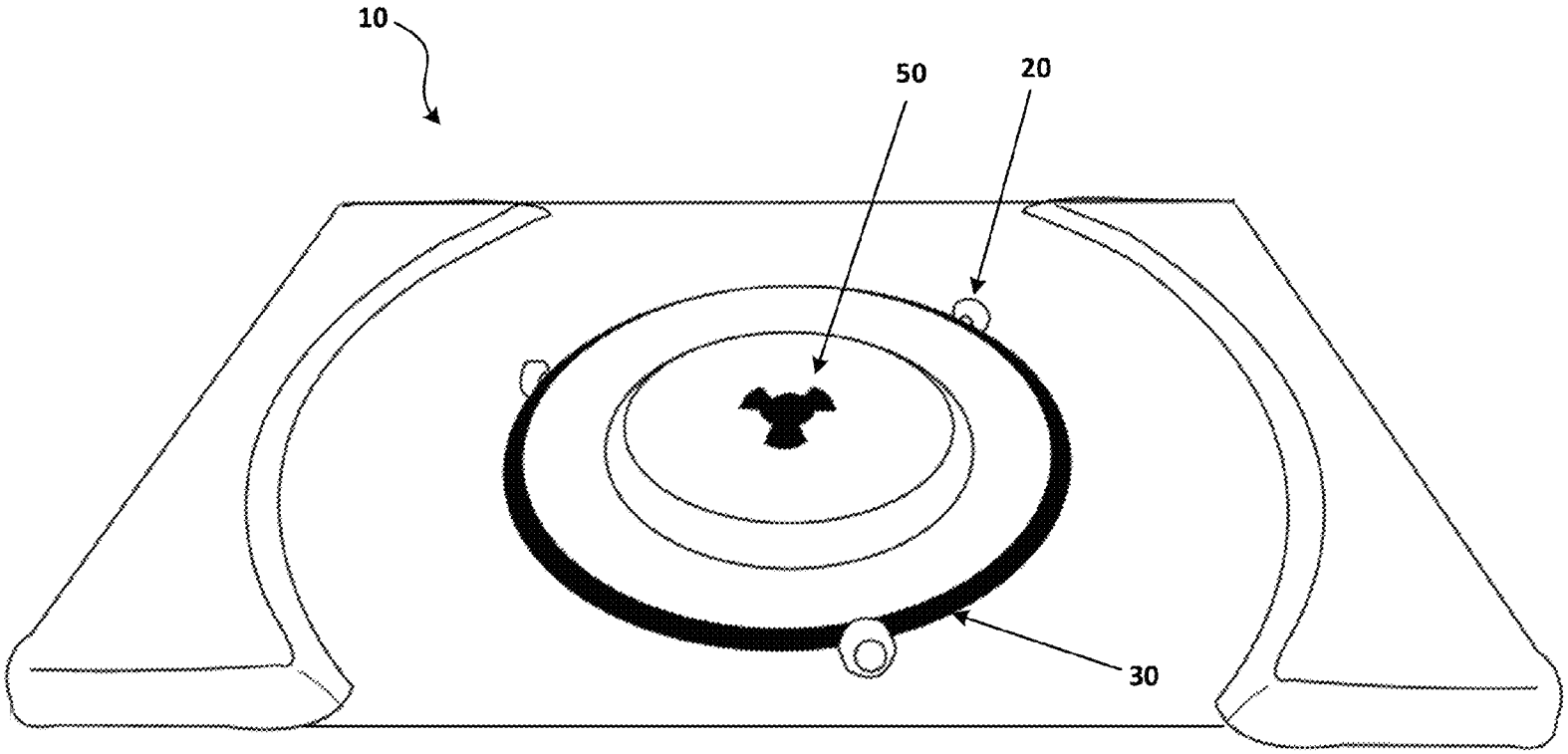
FIG. 1 is an illustration of a bottom, interior surface of a microwave oven in accordance with certain embodiments of the present invention.

In the following description, reference is made to the accompanying drawings that form a part hereof, and in which is shown by way of illustration specific embodiments in which the invention may be practiced. It is to be understood that other embodiments may be utilized and structural changes may be made without departing from the scope of the present invention.

I. Overview of Inventive Principles

In accordance with certain aspects of the present invention, a novel tray is provided for use inside of a microwave oven. In certain embodiments, the microwave tray is circular or disc-shaped and includes an opening or hole located near the center of the tray. The opening in the center of the tray provides access to a rotary coupling located on the floor of the microwave interior. Rather than utilizing the rotary coupling to attach the microwave tray, microwave accessories can be attached to the rotary coupling through the opening. Connection of the microwave accessories to the rotary coupling enables the microwave accessories to perform dynamic functions including, but not limited to, stirring, mixing, rotating and flipping food and other items that are being prepared in the microwave.

An area of the tray located near the opening may include a mating portion that is configured to receive a variety of different microwave accessories. The bottom portions of the microwave accessories include corresponding mating portions that are configured to engage the mating portion of the microwave tray and to secure the accessories to the microwave tray. The bottom portions of the microwave accessories may also include coupling connectors that are configured to engage the rotary coupling located on the bottom surface of the microwave oven. The connections formed between the rotary coupling and the coupling connectors enable dynamic functions to be performed by the accessories. The connections formed by the corresponding mating portions of the accessories and the microwave tray secure the accessory in place while the dynamic functions are being performed.

One innovative microwave accessory that may be utilized in connection with the present invention is a mixing bowl that attaches to the rotary coupling to stir or mix the contents of the bowl. The mixing bowl accessory includes a mixing assembly located near the inner, bottom portion of the bowl.

The mixing assembly includes one or more mixing blades for mixing the contents of the bowl. A bottom coupling portion of the mixing bowl accessory includes a mating portion that is configured to engage a corresponding mating portion of the microwave tray located near the opening in the tray. The bottom surface of the coupling portion may further a coupling connector that is configured to engage the rotary coupling of the microwave oven. The one or more blades of the mixing assembly rotate when the mixing bowl assembly is engaged with the rotary coupling so as to stir the contents of the mixing bowl accessory.

Another innovative microwave accessory that may be utilized in connection with the present invention is a rotary accessory that attaches to the coupling on the floor of the microwave to flip or rotate food or other contents included inside the rotary accessory. A bottom portion of the rotary accessory includes a mating portion that is configured to engage a corresponding mating portion located on the microwave tray near the center opening. The rotary accessory further includes a cylindrical-shaped container assembly which holds food or other contents. One or more detachable caps may be located on either end of the cylinder to enable insertion of food or other contents into the container. The bottom surface of the rotary accessory further includes a coupling connector configured to engage the rotary coupling on the floor of the microwave oven. The container assembly will flip or rotate when the coupling connector is engaged with the rotary coupling. In certain embodiments, the accessory utilizes a conical bevel gear or mitre gear configuration to rotate or spin the container assembly, whereby the rotary coupling causes a first gear component that is situated parallel to the bottom surface of the microwave oven to rotate, which, in turn, cases a second gear component to rotate or spin the container. In certain embodiments, the second gear component is integral with the container assembly and surrounds the container assembly.

In certain embodiments, the microwave tray remains in place while the dynamic portions of the accessories (e.g., the mixing assembly of the mixing bowl and the container assembly of the rotary device) are in motion. However, in certain embodiments, the microwave tray may be outfitted with a plug or cap accessory that enables rotation of the microwave tray. The bottom surface of the plug may include a coupling connector that is configured to engage the rotary coupling and a mating portion that is configured to mate with a corresponding mating portion of the microwave tray. When the plug is engaged with the rotary coupling and the mating portion of the tray, the tray becomes rotatable. The upper surface of the plug may be substantially level with the surface of the microwave tray so as to form a planar or flat surface that allows plates, cups, bowls or other items to be easily balanced or placed atop the microwave tray.

Other types of accessories may also be utilized in connection with the microwave tray. Exemplary accessories may include cookware accessories (e.g., popcorn poppers, pasta cookers and bacon racks) and kitchenware accessories (e.g., plates and cups). Exemplary accessories may also include non-cooking accessories (e.g., crayon makers and candle makers). Any of the accessories may include mating portions that are configured to engage the mating portion of the microwave tray and coupling connectors that are configured to engage the rotary coupling in the microwave oven. Some or all of the accessories may utilize the connection with the rotary coupling to perform dynamic functions.

In certain embodiments, the accessories allow for the easy storage of food or other contents. For example, certain accessories, such as the mixing bowl, may be outfitted with a lid that allows for the easy storage of the contents. The contents can be sealed within the accessories in other ways as well (e.g., using the end caps of the rotary device or other structures).

In certain embodiments, the microwave accessories and microwave trays may be configured to display company logos and advertisements. For example, the microwave accessories and microwave trays may be engraved with company logos or advertisements, or the microwave accessories and microwave trays may be configured to receive inserts that display company logos or advertisements.

The inventive principles described in this disclosure provide a number of advantages. First, the innovative design of microwave tray provides access to the rotary coupling of the microwave, thus enabling the attachment of accessories that can perform dynamic functions (e.g., stirring, mixing, rotating, flipping or other functions). The dynamic functions performed by the accessories enable food to be prepared in a more optimal manner which tastes better and which heats the food thoroughly, thereby eliminating cold spots in the food. Moreover, these dynamic functions further eliminate interruptions in the cooking process, such as interruptions which are necessitated by individuals having to power off the microwave oven in order to manually stir, mix, rotate or flip food that is being heated and then restart the microwave oven after performing such actions. In this sense, the microwave accessories represent "hands free" devices, which eliminate the need to tend to food during the cook cycle.

Other advantages of the invention can be attributed to the mating mechanism that secures the accessories to the microwave tray while the microwave is powered on. Destabilizing forces are imposed on the accessories as a result of the motions caused by performance of the dynamic functions. Thus, without the mating portions of the accessories and the tray, the microwave accessories may tip over and, thus, and negatively impact the cooking process and contents being heated.

Further advantages can be attributed to the novel plug that serves to convert the microwave tray into a rotatable tray that can spin items placed on the tray in a manner which is akin to typical microwave turntables. This means that the microwave tray can serve as both a typical revolving microwave tray, as well as a tray that allows for the attachment of accessories that perform dynamic functions. Even further advantages relate to the fact that the microwave tray and related inventive aspects can be utilized to retrofit nearly any existing microwave oven, given that the nearly all microwaves are outfitted with a rotary coupling that can enable the dynamic functions to be performed by the accessories.

Even further advantages can be attributed to the storage utility of the microwave accessories. Storage is made easy and convenient by simply attaching lids, caps or other structures to the microwave accessories. Thus, an individual that utilizes an accessory to heat food can then use the accessory to store the food by easily sealing it with a lid, cap or other structure. These and other advantages will be apparent based on the disclosure herein.

II. Exemplary Embodiments of a Microwave Tray and Removable Tray Plug

FIG. 1 illustrates a bottom, interior surface 10 of a microwave oven in accordance with certain embodiments of the present invention. A rotary coupling 50 is located near the center of the surface 10. The exemplary rotary coupling 50 illustrated in the figures comprises a three-pronged, triangular-shaped structure. However, the rotary coupling 50 may generally be formed in any shape or configuration (e.g., square-shaped or circular-shaped structures). The rotary coupling 50 may be directly or indirectly connected to a motor. For example, a bottom portion of the rotary coupling 50 that extends through the bottom surface 10 of the microwave oven may include, or be connected to, a shaft that is coupled to a motor. The motor may be located beneath the interior surface 10 of the microwave oven or in a different location within the microwave oven. The motor may be activated when the microwave oven is powered on and the microwave oven is emitting radiation to heat the interior of the microwave oven. Activation of the motor may cause the rotary coupling 50 to spin or rotate in a circular motion.

The interior of the microwave oven may further include a support element 30 that can hold or support a microwave tray and assist the microwave tray with rotating inside of the microwave oven. The exemplary support element 30 shown in the figures is a circular ring and includes a plurality of wheels that facilitate and enable rotation of the support element 30, as well as any microwave tray that rests atop the support element 30. Other types of support elements 30 may also be utilized in connection with the present invention including, but not limited to, multi-armed (e.g., three-armed) or triangular-shaped support elements which may be coupled to the microwave floor 10 at or near the location of the rotary coupling.

FIGS. 2A-2K illustrate novel microwave trays 100 for use inside the microwave oven in accordance with certain embodiments of the present invention. In contrast to conventional microwave trays, the microwave tray 100 includes an opening or hole 175 located in the center of the tray which provides access to the rotary coupling 50 when the tray is placed within the microwave oven (e.g., see FIG. 2C). As explained in further detail below, a variety of different microwave accessories can be mounted on the microwave tray and connected to the rotary coupling 50 located on the bottom surface 10 of the microwave oven. The connection to the rotary coupling 50 permits the microwave accessories to perform dynamic functions (e.g., such as stirring, mixing, flipping or rotating) in connection with food or other items that are being prepared in the microwave oven.

The exemplary microwave tray 100 illustrated in the figures is preferably circular in shape and is formed of a glass, a polymer, or a plastic, or any combination thereof, which is suitable for use within a microwave oven. However, the shape and composition of the microwave tray 100 can vary according to other embodiments. Generally speaking, the microwave tray 100 may be provided in any shape (e.g., square, rectangle, triangle, oval, etc.) and may be of any composition. Likewise, while the opening 175 in the center of the microwave tray 100 may be shown as being a circular, the opening 175 can also be provided in any shape and width that is sufficient to provide access to the rotary coupling 50 on the bottom surface of the microwave oven. The microwave tray 100 and opening 175 can be any size or dimension. Exemplary microwave trays 100 may have an upper or lower surface which has diameter of 8-20 inches and may be approximately a half inch in thickness. The opening 175 in the tray may have a diameter of 1-5 inches.

In certain embodiments, the center portion of the microwave tray 100 located near the opening 175 includes a mating portion 120A that permits a microwave accessory to be mounted to the tray 100 and which secures the microwave accessory in place on the tray 100. The exemplary mating portion 120A illustrated in the figures includes a plurality of teeth located on the interior rim of the opening 175 and a plurality of recesses located on the top surface of the tray around the circumference of the opening 175. As discussed in further detail below, accessories may include corresponding mating portions (e.g., as referenced by 120B in FIGS. 2C, 3B and 4B) to provide a secure connection of the accessories to the tray 100. For example, the bottom portions of the accessories may include corresponding recesses that engage and/or lock with the teeth on the tray 100, as well as corresponding teeth that engage and/or lock with the recesses on the tray 100. In the exemplary embodiments shown in the figures, the mating portion 120A of the tray 100 includes three equally spaced teeth located on an interior rim of the opening 175 and three equally spaced recesses located around the opening 175 on the upper surface of the tray. The exemplary accessories shown in the figures include mating portions 120B that include three equally spaced recesses that are configured to engage the teeth on the tray and three equally spaced teeth that are configured to engage the recesses on the tray 100.

The microwave tray 100 and accessories may be outfitted with other types of mating portions. For example, the mating mechanisms (e.g., collectively 120A and 120B) utilized to connect the microwave tray and accessories may include any of the following connection mechanisms: interlocking thread connectors, press fit or friction connectors, snap connectors, and interlocking teeth and recesses. In certain embodiments, the mating mechanisms may include recesses located on the top surface the tray 100 that are configured to engage feet or foot structures located on the bottom of the microwave accessories, or vice versa. In certain embodiments, the opening 175 in the center of the tray 100 may serve as a mating connector itself. For example, in the case that the opening 175 is circular, a bottom portion of an accessory may comprise a circular mating structure that has a reduced circumference so as to fit inside of the opening 175, while a portion of the accessory extends over the top surface of tray 100 and rests on the tray 100, thus securely mounting the accessory to the tray 100. Other types of mating mechanisms may also be utilized.

The bottom surface of the microwave tray 100 may be further configured to engage the support element 30 and/or bottom surface 10 of the microwave oven. For example, the bottom surface of the microwave tray 100 may include a circular track or ring that is configured to receive a circular support element 30, or may include indentations, recesses or other configurations that are configured to receive a multi-armed or triangular support element. Likewise, the bottom surface of the microwave tray 100 may alternatively, or additionally, include feet or other structures that permit the tray to rest on the bottom surface 10 of the microwave oven.

According to certain embodiments, the microwave tray 100 remains stationary (or rotates minimally) when the microwave oven is powered on. For example, when the microwave oven is powered on and a microwave accessory is mounted on the tray 100, the tray 100 will still remain stationary even though the microwave accessory, or portions thereof, may be rotating or otherwise moving. Likewise, the tray 100 may remain stationary when there is nothing mounted on the tray 100 and the opening 175 remains exposed.

In accordance with certain embodiments, a tray plug 150 may be inserted into the opening 175 of the microwave tray 100 to enable the microwave tray to rotate (e.g., shown in 2A-2F and 2J), thus converting the microwave tray 100 into a rotatable turntable that operates in a manner that is similar to many typical turntables. The exemplary tray plug 150 illustrated in the figures is circular in shape and is preferably formed of a glass, a polymer, or a plastic, or a combination thereof suitable for use in a microwave oven. However, the tray plug 150 can be any shape (e.g., square, rectangle, triangle, oval, etc.) and be of any composition, and the corresponding opening in the microwave tray 150 can be varied to accommodate insertion of tray plugs 150 having different shapes and sizes. Exemplary tray plugs 150 may have a diameter of 1-5 inches and may be approximately a half inch in thickness.

In certain embodiments, the tray plug 150 includes a mating portion 120B near its edge that is configured to engage the mating portion 120A on the microwave tray 100. The exemplary mating portion 120BA of the tray plug 150 illustrated in the figures includes a plurality of recesses located on its bottom surface and a plurality of teeth located on the edge of the tray plug 150. The mating portion 120B of the tray plug 150 is configured to engage with the teeth and recesses located near the opening 175 of the microwave tray 100. As explained above, the tray plug 150 and other accessories may utilize other types of mating mechanisms.

Figure 2A:
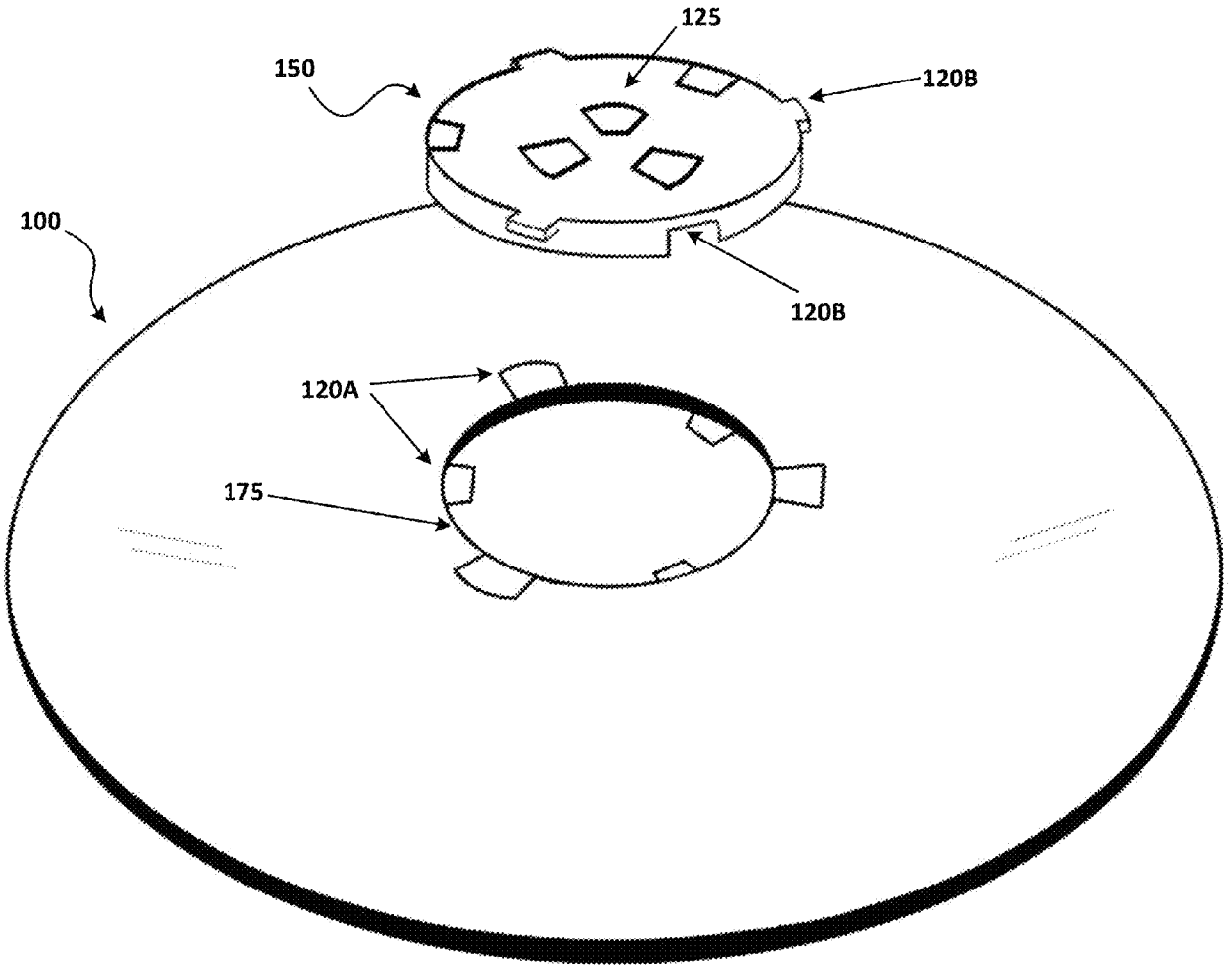
FIG. 2A is an exploded view of a microwave tray and associated tray plug in accordance with certain embodiments of the present invention.
Figure 2B:
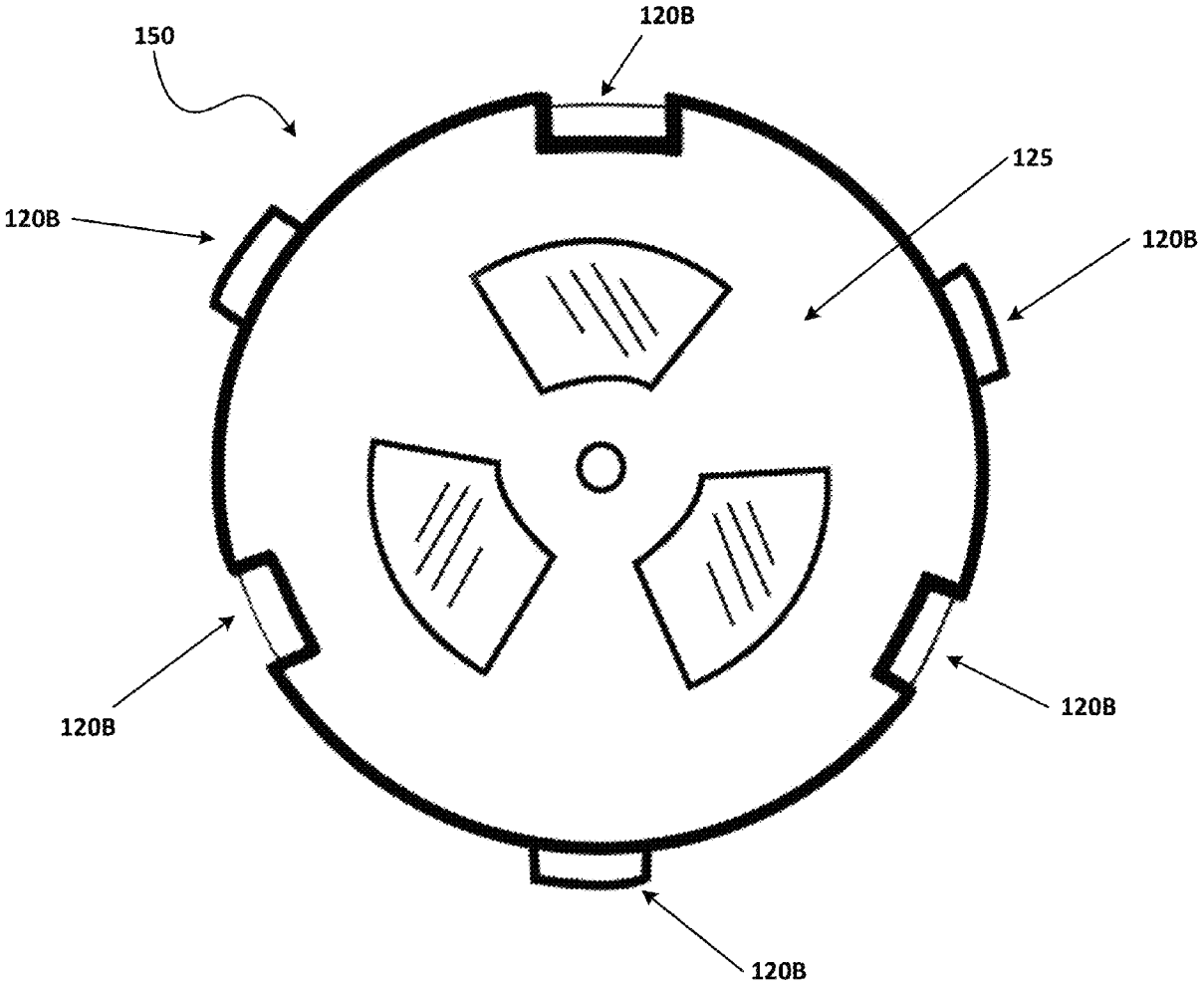
FIG. 2B is an illustration of a bottom surface of a tray plug in accordance with certain embodiments of the present invention.
Figure 2C:
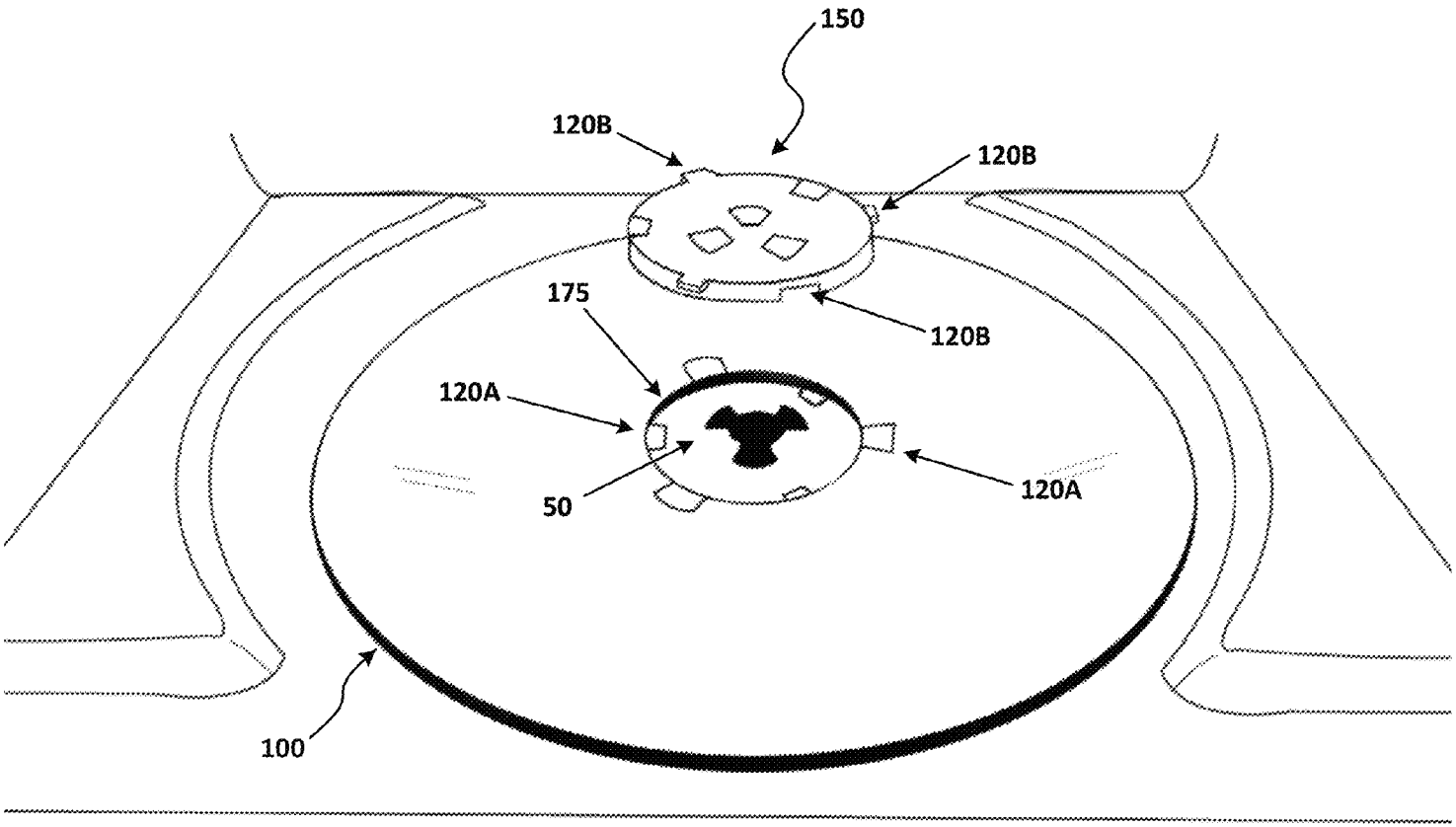
FIG. 2C is an illustration of a microwave tray having a detached tray plug shown inside of a microwave oven in accordance with certain embodiments of the present invention.
Figure 2D:
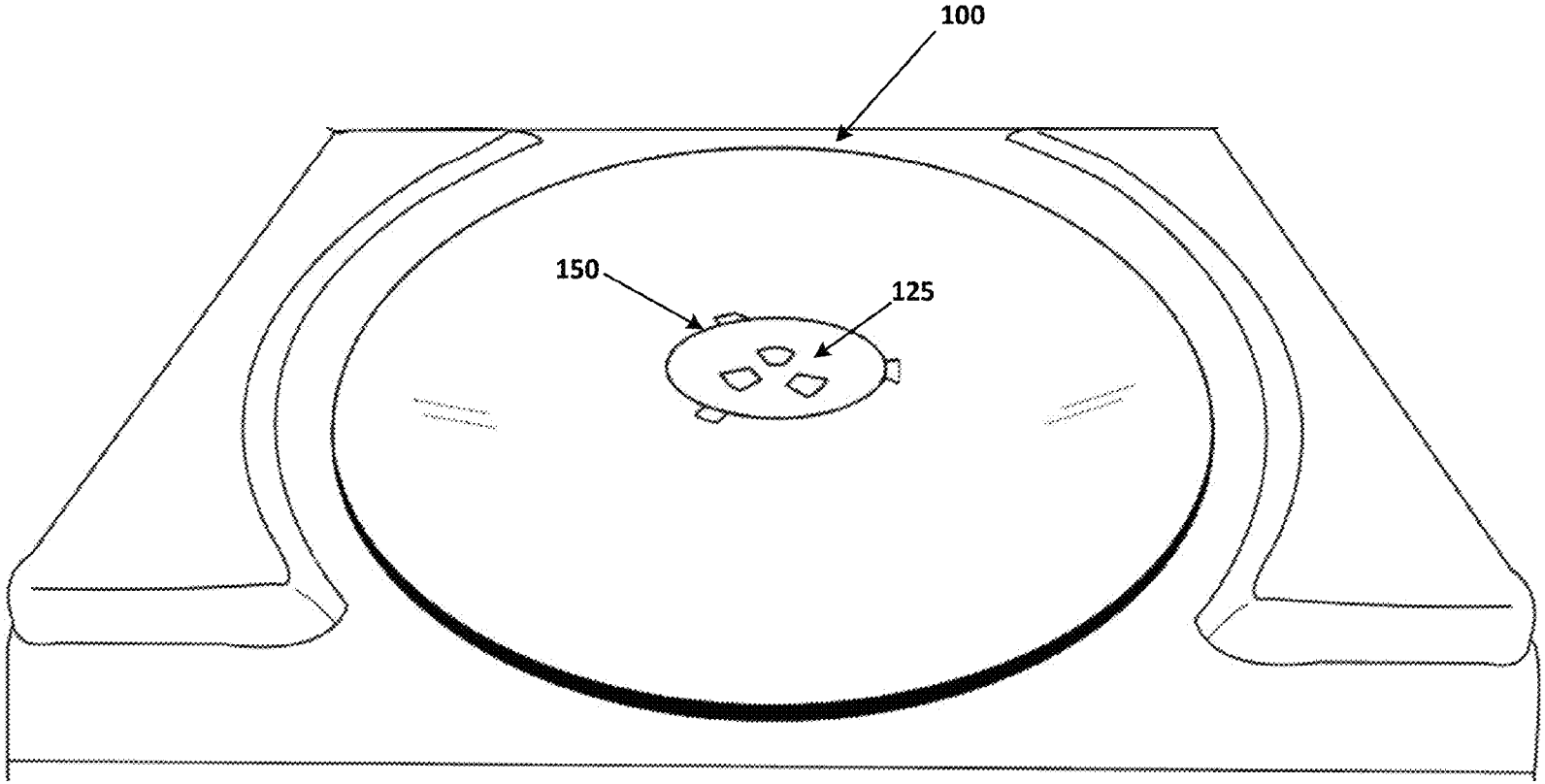
FIG. 2D is an illustration of a microwave tray with an attached tray plug shown inside of a microwave oven in accordance with certain embodiments of the present invention.
Figure 2E:
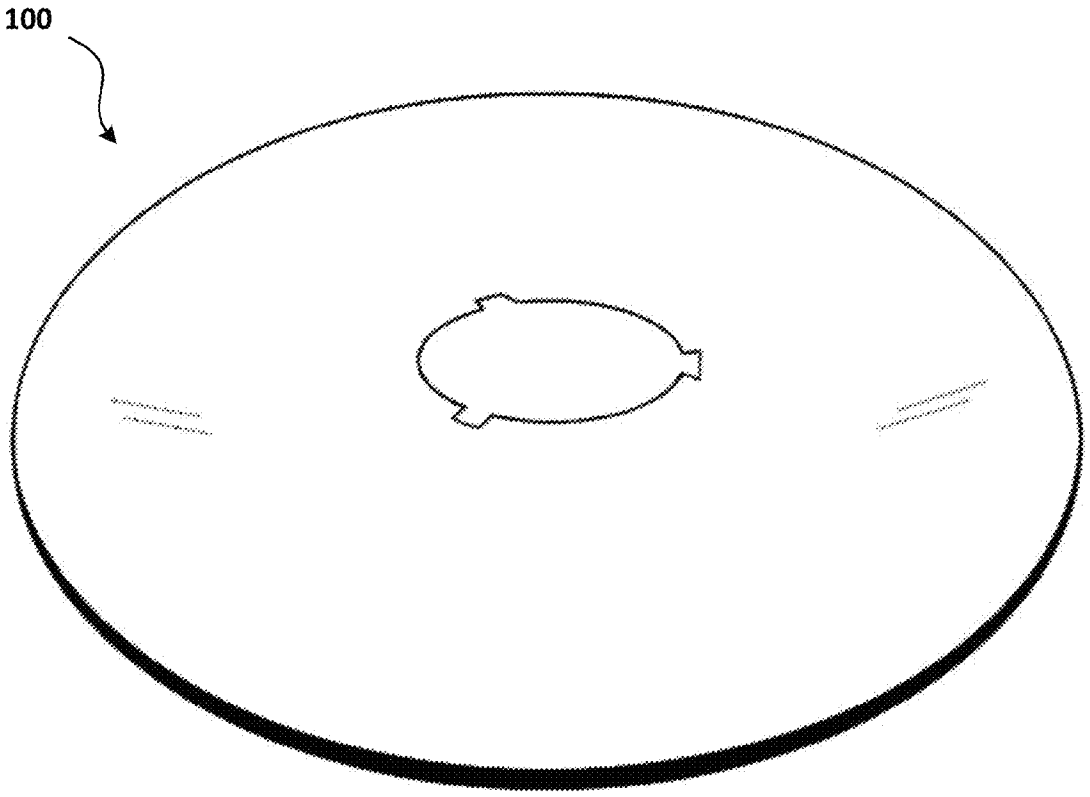
FIG. 2E is a perspective view of a microwave tray with a removable tray plug in accordance with certain embodiments of the present invention.
Figure 2F:
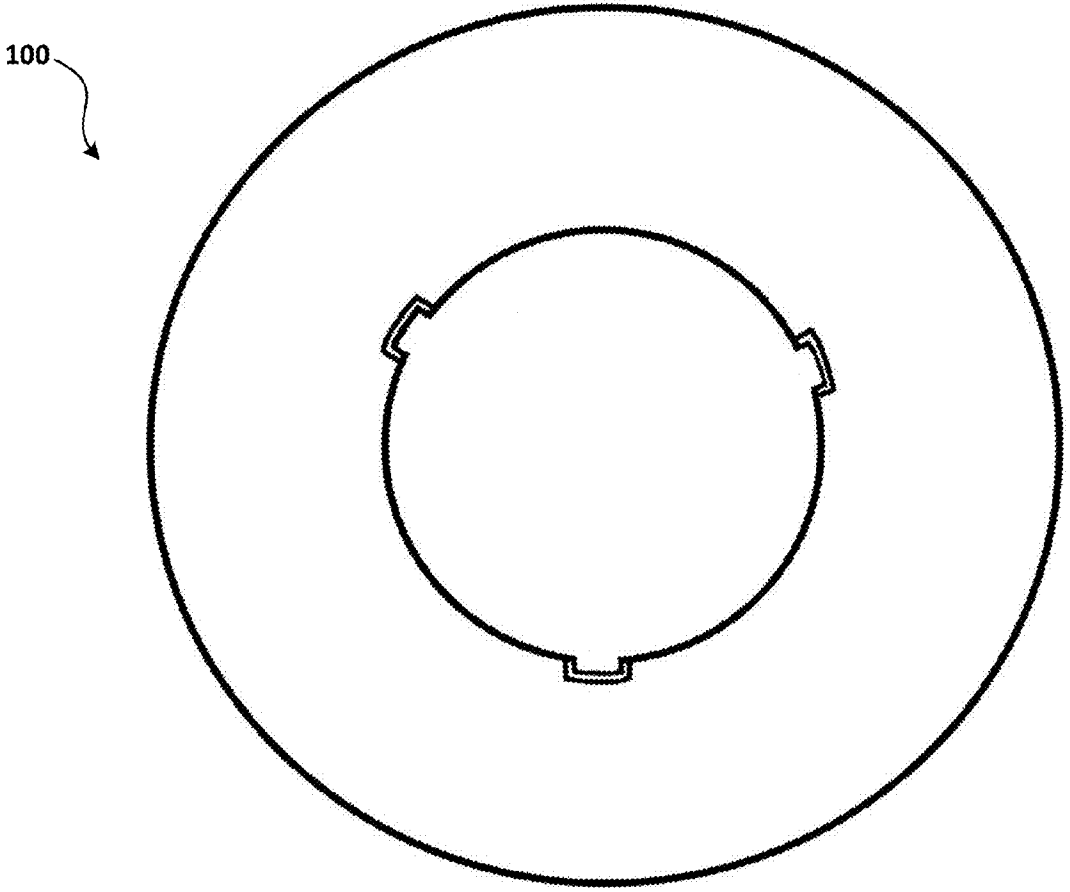
FIG. 2F is a top view of a microwave tray with a removable tray plug in accordance with certain embodiments of the present invention.
Figure 2G:
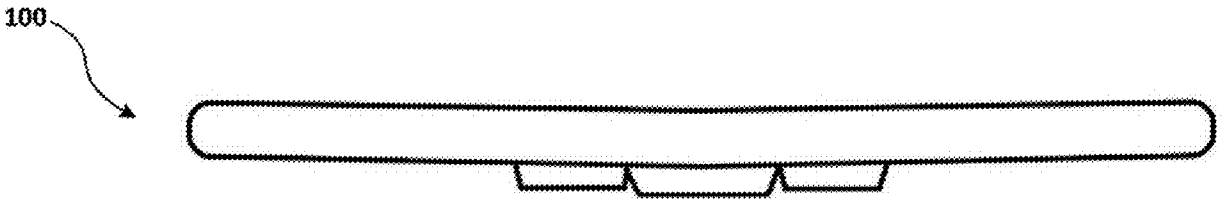
FIG. 2G is front view of a microwave tray with a removable tray plug in accordance with certain embodiments of the present invention.
Figure 2H:
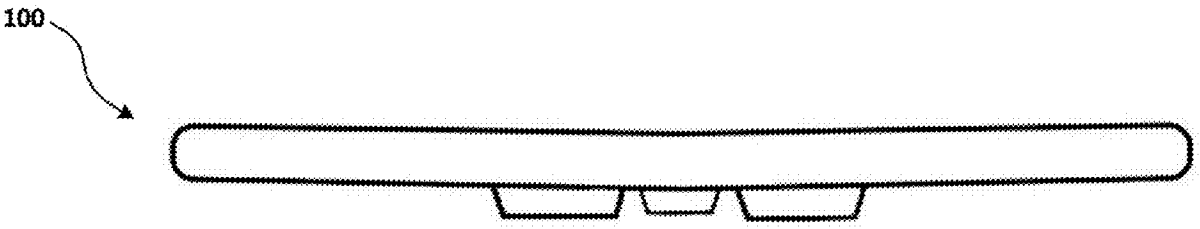
FIG. 2H is rear view of a microwave tray with a removable tray plug in accordance with certain embodiments of the present invention.
Figure 2I:
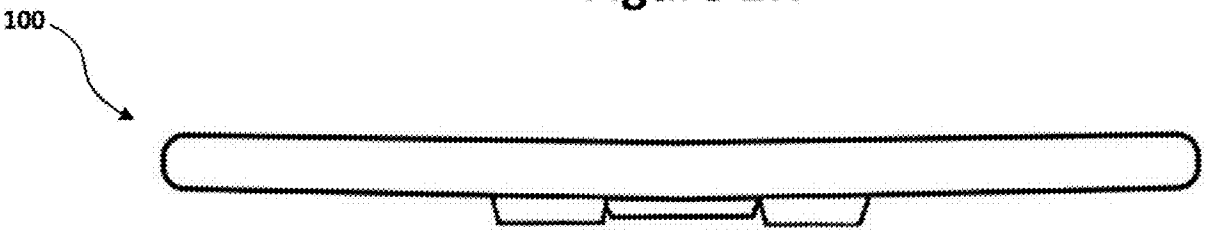
FIG. 2I is right side or left side view of a microwave tray with a removable tray plug in accordance with certain embodiments of the present invention.
Figure 2J:
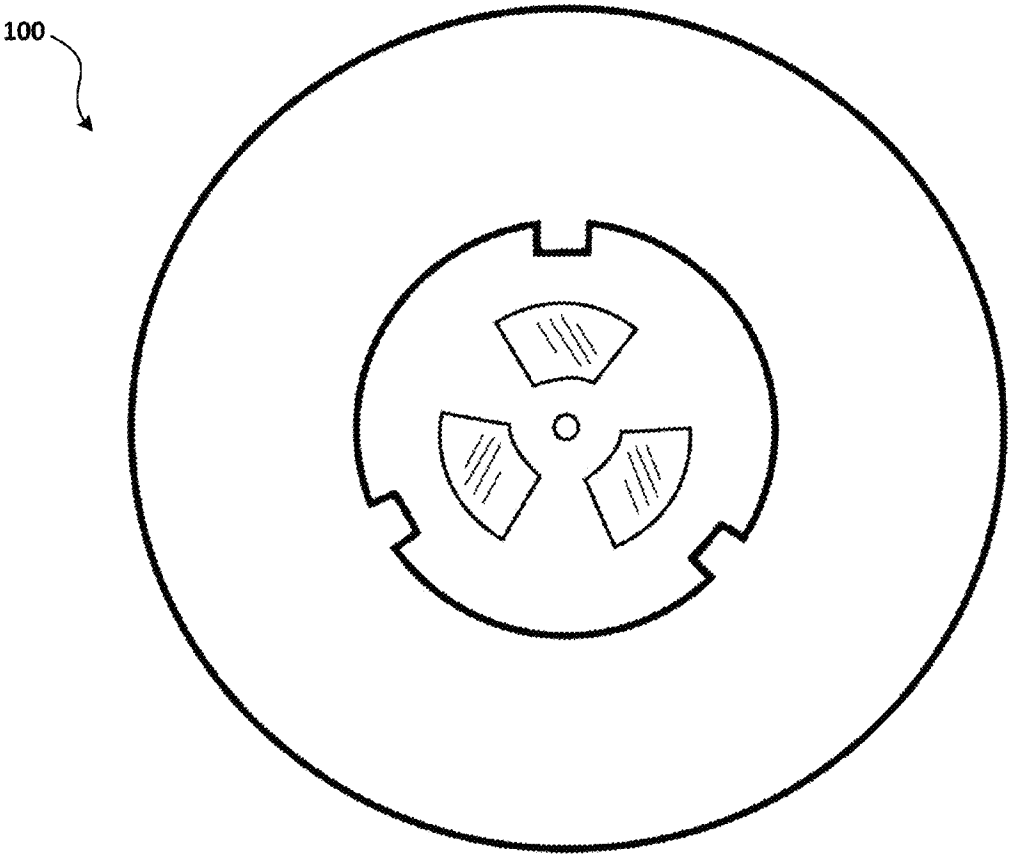
FIG. 2J is bottom view of a microwave tray with a removable tray plug in accordance with certain embodiments of the present invention.
Figure 2K:
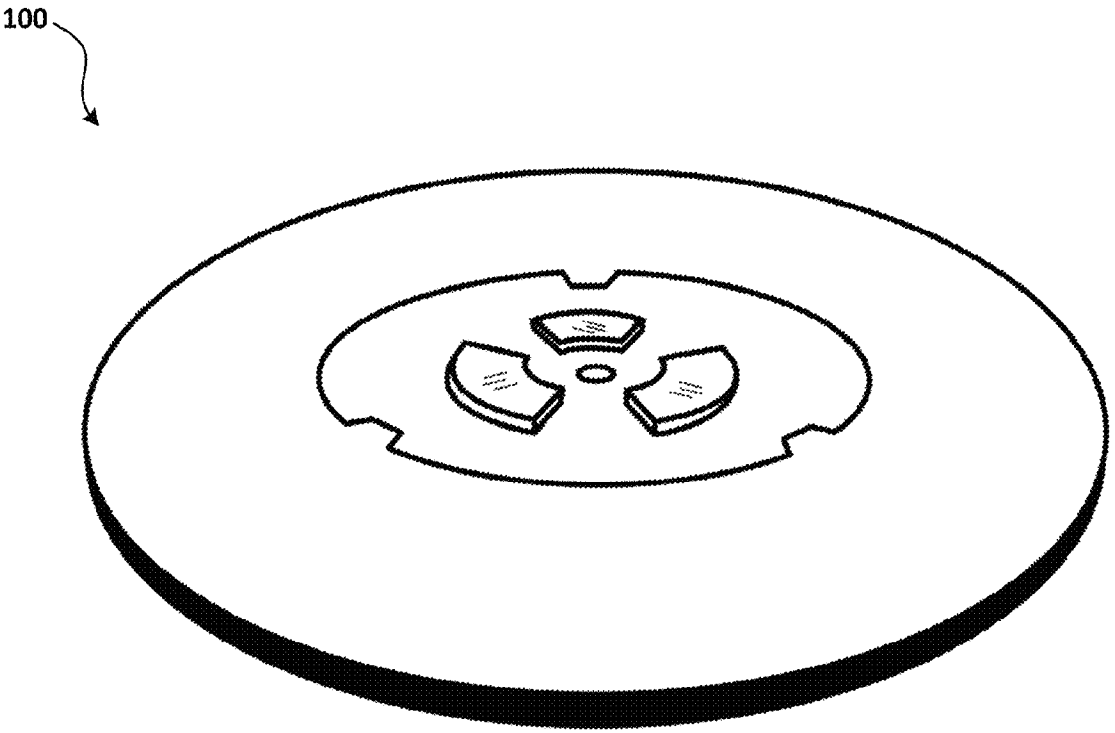
FIG. 2K is a perspective view of a bottom surface of a microwave tray with a removable tray plug in accordance with certain embodiments of the present invention.

The bottom surface of the tray plug 150 also includes a coupling connector 125 that is configured to engage the rotary coupling 50 on the bottom surface 10 of the microwave oven (e.g., see FIGS. 2B and 2J-K). The exemplary coupling connector 125 shown in the figures includes three raised notches that are configured to engage a three-pronged rotary coupling 50 as shown in the figures. Specifically, the three prongs of the rotary coupling 50 can fit into the spaces between the raised notches included on the coupling connector 125. The coupling connector 125 can be varied to accommodate any other structure or configuration of the rotary coupling 50.

When the microwave oven is powered on (e.g., when radiation is being emitted to heat the contents within the microwave oven), the motor in the microwave oven causes the rotary coupling 50 to spin or rotate. The connection between the coupling connector 125 of the tray plug 150 and the rotary coupling 50 on the floor 10 of the microwave oven causes the microwave tray 100 to spin. This rotation of the microwave tray 100 is enabled by the connection formed by the mating connectors 120A, 120B of the tray plug and microwave tray, which serve to lock the tray plug 150 and the microwave tray 100 together. Because the tray plug 150 and microwave tray 100 are locked together, both the tray plug and microwave tray will rotate in unison with the rotary coupling 50 as it rotates or spins.

In certain embodiments, the upper surface of the tray plug 150 is substantially level or planar. Thus, when the tray plug 150 is inserted into the opening 175 of the microwave tray 100, a substantially flat and continuous surface is formed with the microwave tray. Food, cookware (e.g., plates, cups, bowls, etc.) or other items can be placed on the level surface that is formed by the tray plug and microwave tray.

It should be noted that although the coupling connector 125 is located on the bottom surface of the tray plug 150, the coupling connector 125 is visible on the upper surface of tray plug 150 in certain figures (see, e.g., FIGS. 2A, 2C and 2D) because the tray plug 150 may be transparent or semi-transparent. In other figures (see, e.g., FIGS. 2E and 2F), the coupling connector 125 is not shown as being visible on the upper surface of the tray plug 150.

III. Exemplary Embodiments of a Mixing Bowl Accessory

One inventive microwave accessory that may be mounted to the microwave tray 100 is a mixing bowl accessory 300 that utilizes the connection with the rotary coupling 50 to mix or stir food or other contents within the accessory. Exemplary embodiments of a mixing bowl accessory are illustrated in FIGS. 3A-3D.

Figure 3A:
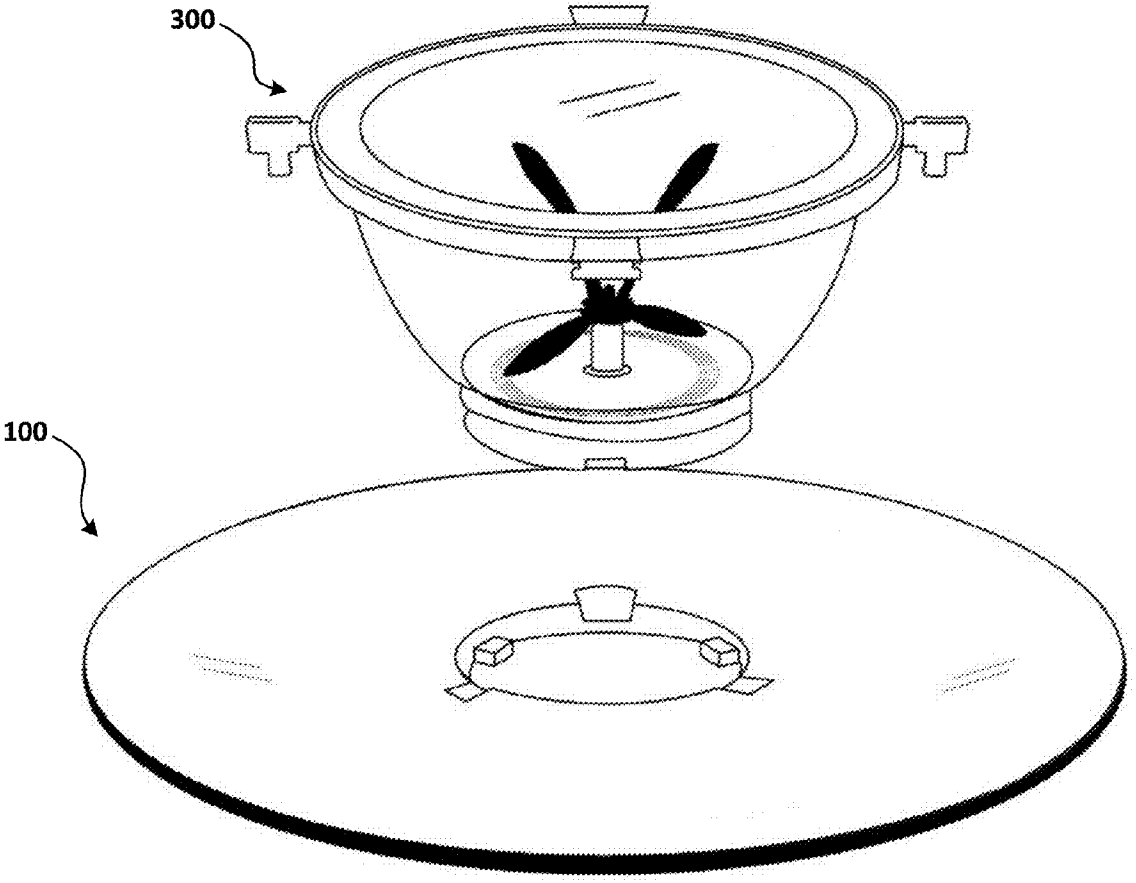
FIG. 3A is an illustration of a mixing bowl accessory that is configured for use with a microwave tray in accordance with certain embodiments of the present invention.
Figure 3B:
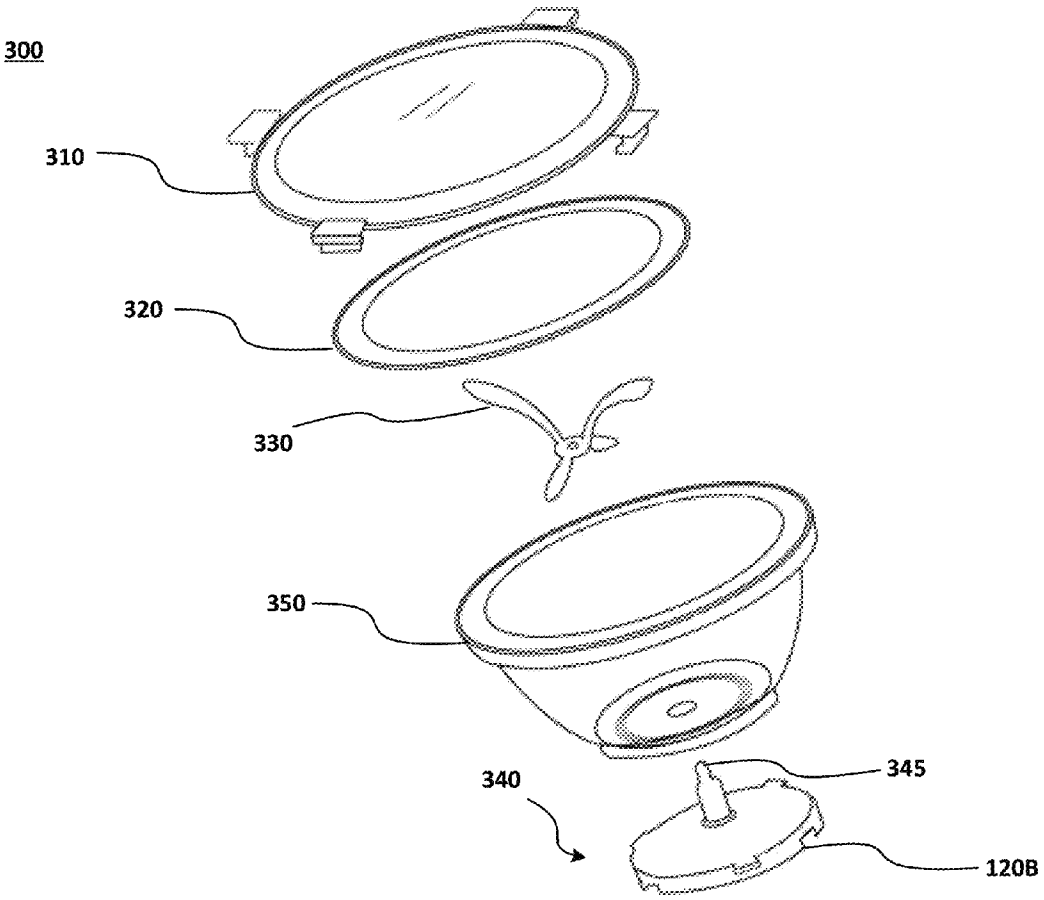
FIG. 3B is an exploded view of a mixing bowl accessory in accordance with certain embodiments of the present invention.
Figure 3C:
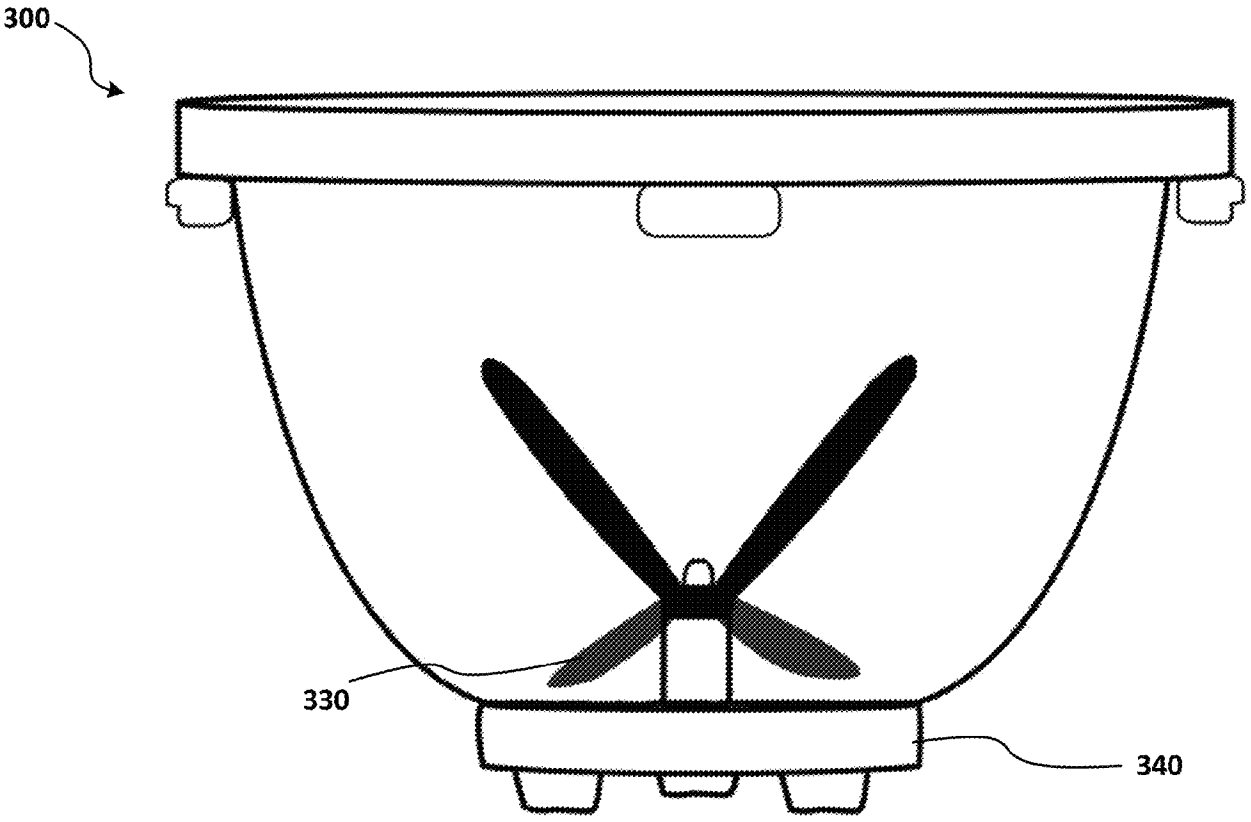
FIG. 3C is a side view of a mixing bowl accessory in accordance with certain embodiments of the present invention.
Figure 3D:
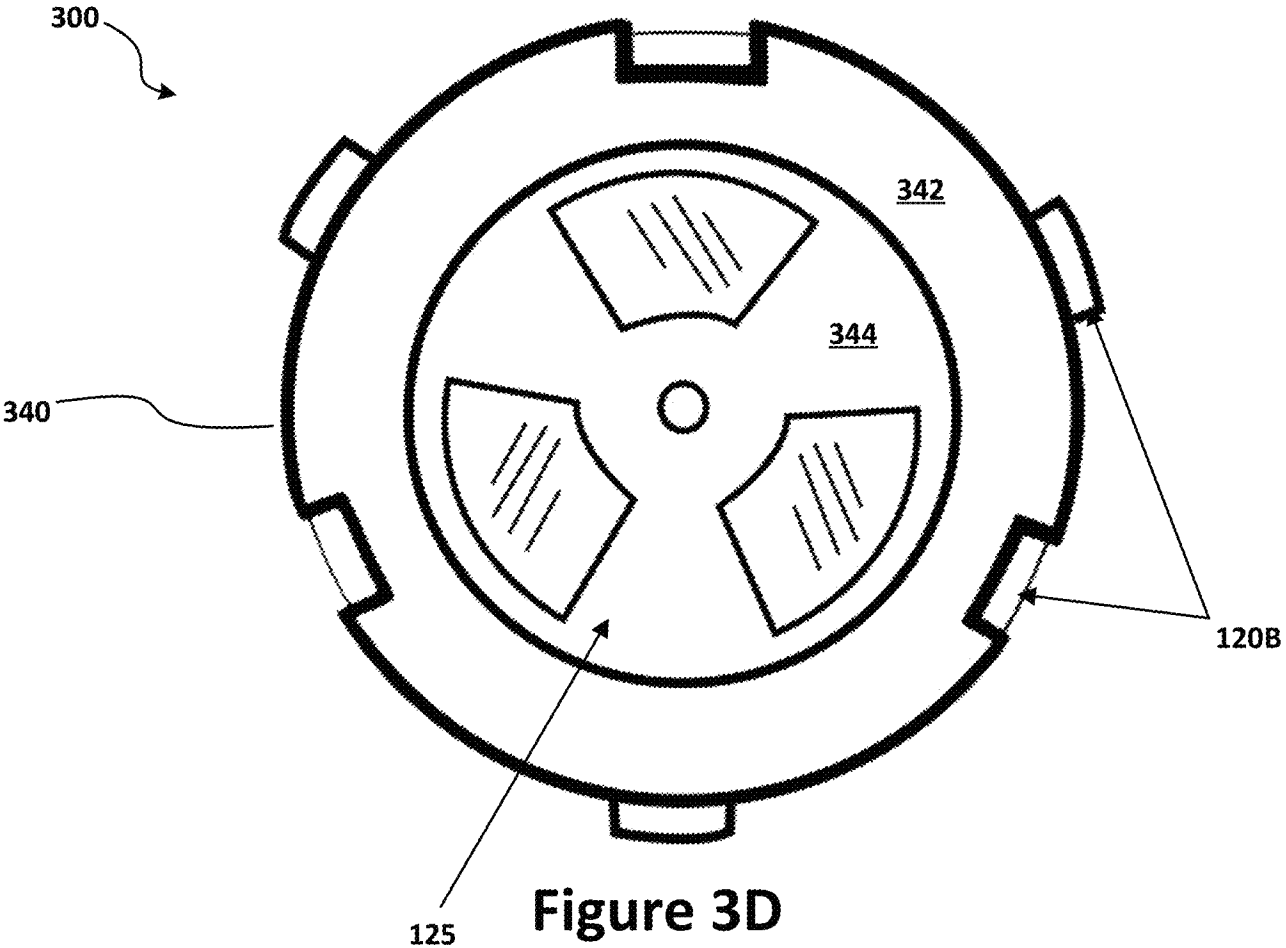
FIG. 3D is a bottom view of a coupling portion of a mixing bowl accessory in accordance with certain embodiments of the present invention.

FIG. 3B provides an exploded view of a mixing bowl accessory 300 according to certain embodiments. In certain embodiments, the mixing bowl accessory 300 is comprised of a plurality of components including a bowl portion 350, a coupling portion 340, a mixing assembly 330, a rim 320 and a detachable lid 310. The underside of the coupling portion (e.g., as shown in FIG. 3D) includes a coupling connector 125 and the topside of the coupling portion 340 includes a shaft 345 that extends upward from the surface of the coupling portion 340. The bottom of the bowl 350 includes a hole that receives the shaft 345. The mixing assembly 330 can be attached to the shaft 345 when the shaft 345 is inserted through the hole. The rim 320 can be attached or connected to the upper edge surface of the bowl in any appropriate manner (e.g., using an adhesive, snap connector, or other type of connection mechanism). The lid 310 can be attached to and detached from lid using a variety of different connection mechanisms (e.g., via a snap fit connection or press fit connection).

The components of the mixing bowl accessory 300 are preferably formed of a glass, a polymer, or a plastic, or any combination thereof, which is suitable for use in a microwave oven. However, the composition of the mixing bowl accessory 300 can vary according to other embodiments and may generally be of any composition. The shape of the bowl portion 350 shown in the figures is intended to be one exemplary configuration. However, the shape of the bowl portion 350 (or other portion of the mixing bowl accessory) can be varied.

When the coupling portion 340 of the mixing bowl accessory 300 is engaged with the rotary coupling 50 and the microwave oven is powered on, the rotary coupling 50 will cause the coupling portion 340 to rotate, which, in turn, will cause the mixing assembly 330 to rotate. Thus, the mixing assembly 330 will mix or stir the contents included within the bowl portion 350 when the coupling connector 125 on the bottom surface of the coupling portion 340 is engaged with the rotary coupling 50.

As shown in FIG. 3D, the bottom surface of the coupling portion 340 includes an outer surface 342 and an inner surface 344. The outer surface 342 and inner surface 344 are both circular in shape and share a common center point. The inner surface 344 is decoupled from the outer surface 342 such that it may rotate freely. When the mating portions 120A, 120B of the accessory 300 and the tray 100 are engaged and the coupling connector 125 is engaged with the rotary coupling 50 while it is rotating, the outer surface 342 will remain stationary with respect to the microwave tray 100 and inner surface 344 will rotate. The rotation of the inner surface 344 causes the shaft 345 to rotate, which, in turn, causes the mixing assembly 330 to rotate.

In certain embodiments, the coupling portion 340 of the mixing bowl accessory 300 comprises two components: a shell component that includes the upper surface of the coupling portion 340, the outer bottom surface 342, and the side walls of the coupling portion that connect the upper surface to the outer bottom surface 342; and rotatable portion that includes the inner bottom surface 344 and the shaft 345. The rotatable portion of the coupling portion 340 can be coupled to the rotary coupling 50 to enable rotation of the shaft 345 and mixing assembly 330 attached to the shaft 345.

The exemplary mixing assembly 330 depicted in the figures includes three mixing blades. However, the mixing assembly can be varied to include any number of mixing blades and can include other types of structures for mixing the contents included within the bowl portion 350. The mixing assembly 330 can be attached to the shaft 345 on the coupling portion in any appropriate manner. In certain embodiments, the mixing assembly 330 is attached to the shaft 345 using a press fit, an interference fit or friction fit connection.

The lid 310 can be attached to the upper rim of the bowl using the fasteners located on the periphery of the lid to assist with storing the contents within the bowl (e.g., when leftovers are placed in the refrigerator for storage) or to assist with reducing splatter when the microwave accessory is being utilized in the microwave oven. The exemplary lid shown in the figures includes four fasteners. However, any number of fasteners can be included on the lid to assist with securing the lid to the bowl. The lid can be attached to the bowl portion 350 in any other known manner (e.g., using a press fit connection or other type of connection).

The configuration of the mixing bowl accessory 300 illustrated in FIG. 3A can vary. For example, in certain embodiments, the mixing bowl accessory 300 is simplified and is comprised primarily of two pieces, namely, an upper bowl portion 350 and a lower coupling portion. A coupling connector is located on the bottom surface of the coupling portion 340 to facilitate connection of the accessory to the rotary coupling of the microwave oven.

Regardless of the configuration of the bowl, in certain embodiments, the mixing bowl accessory 300 may be outfitted with a bottom replacement unit that can assist an individual with eating directly from the mixing bowl accessory 300 and/or storing food. For example, when the coupling portion 340 of the mixing bowl accessory 300 is removed, the bottom replacement unit can be attached to the bottom surface of the mixing bowl accessory 300 to plug the hole in the bottom of the bowl portion 350, thus allowing an individual to eat from the accessory 300 and/or store food without the shaft 345 protruding into the body of the bowl portion 350.

IV. Exemplary Embodiments of a Rotary Device Accessory

Another inventive microwave accessory that may be mounted to the microwave tray 100 is a rotary device accessory 400 that utilizes the connection with the rotary coupling 50 to flip or rotate food or other contents within the accessory. Exemplary embodiments of rotary accessories are illustrated in FIGS. 4A-F.

Figure 4A:
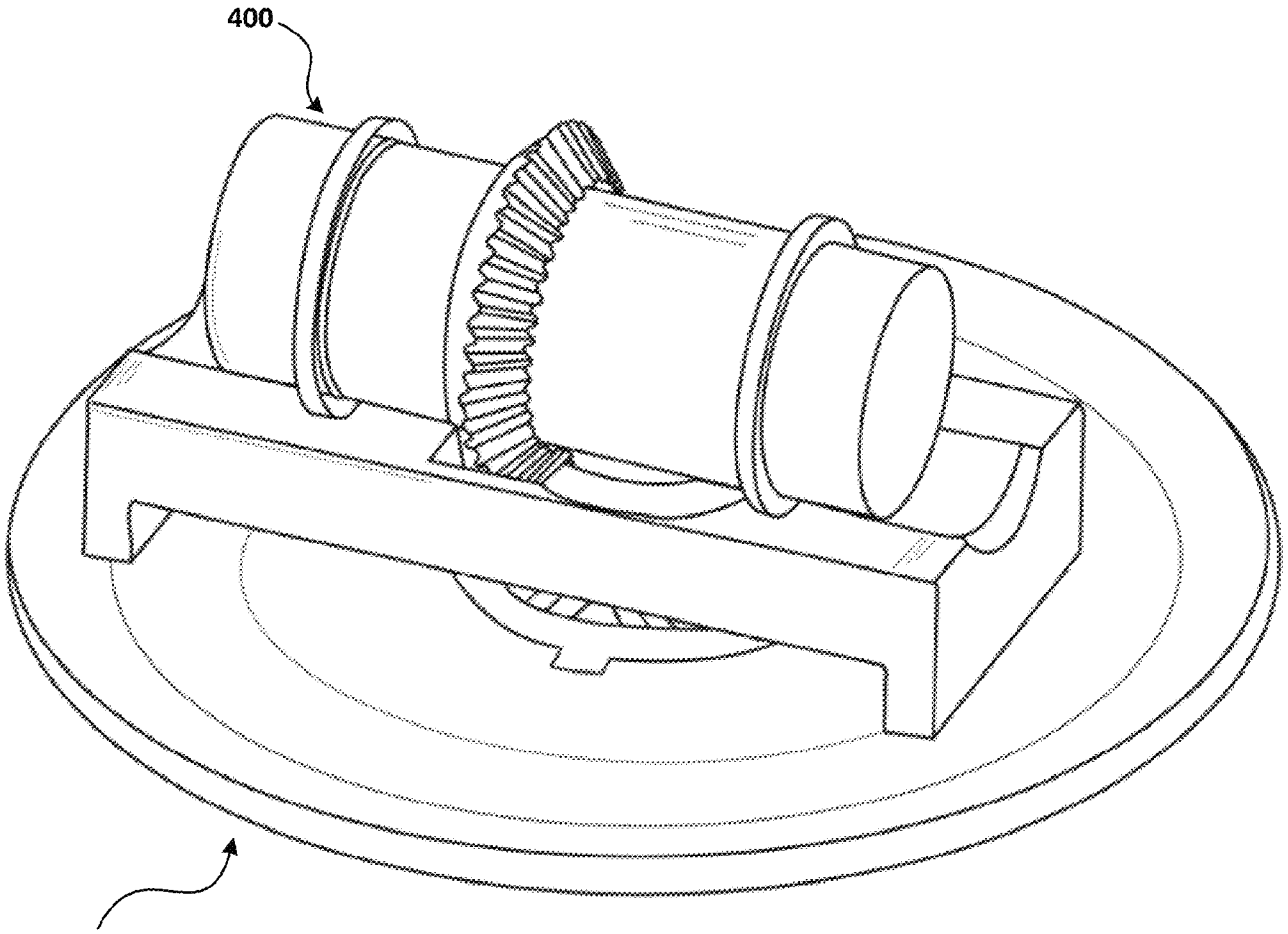
FIG. 4A is an illustration of a rotary accessory that is configured for use with a microwave tray in accordance with certain embodiments of the present invention.
Figure 4B:
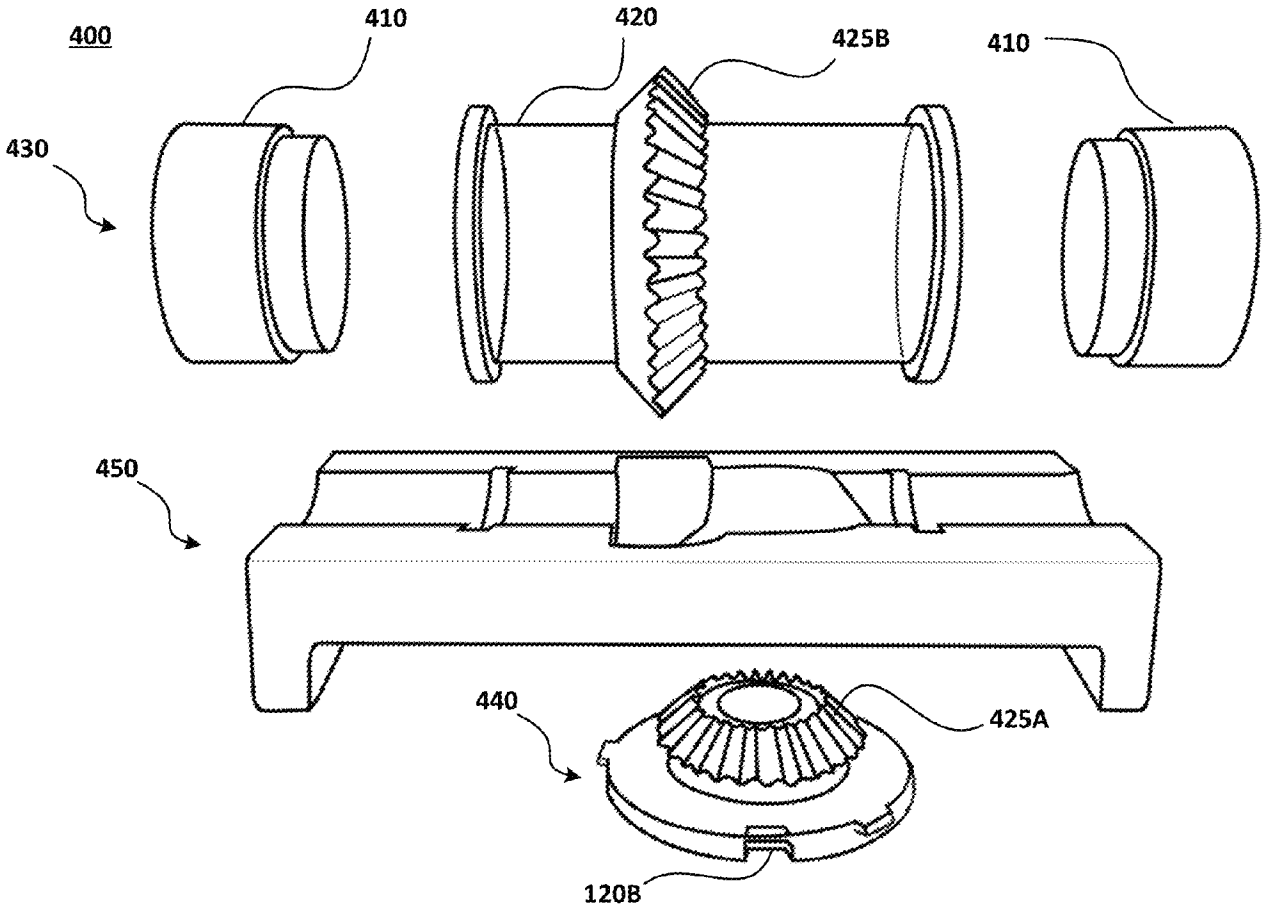
FIG. 4B is an exploded view of a rotary accessory in accordance with certain embodiments of the present invention.
Figure 4C:
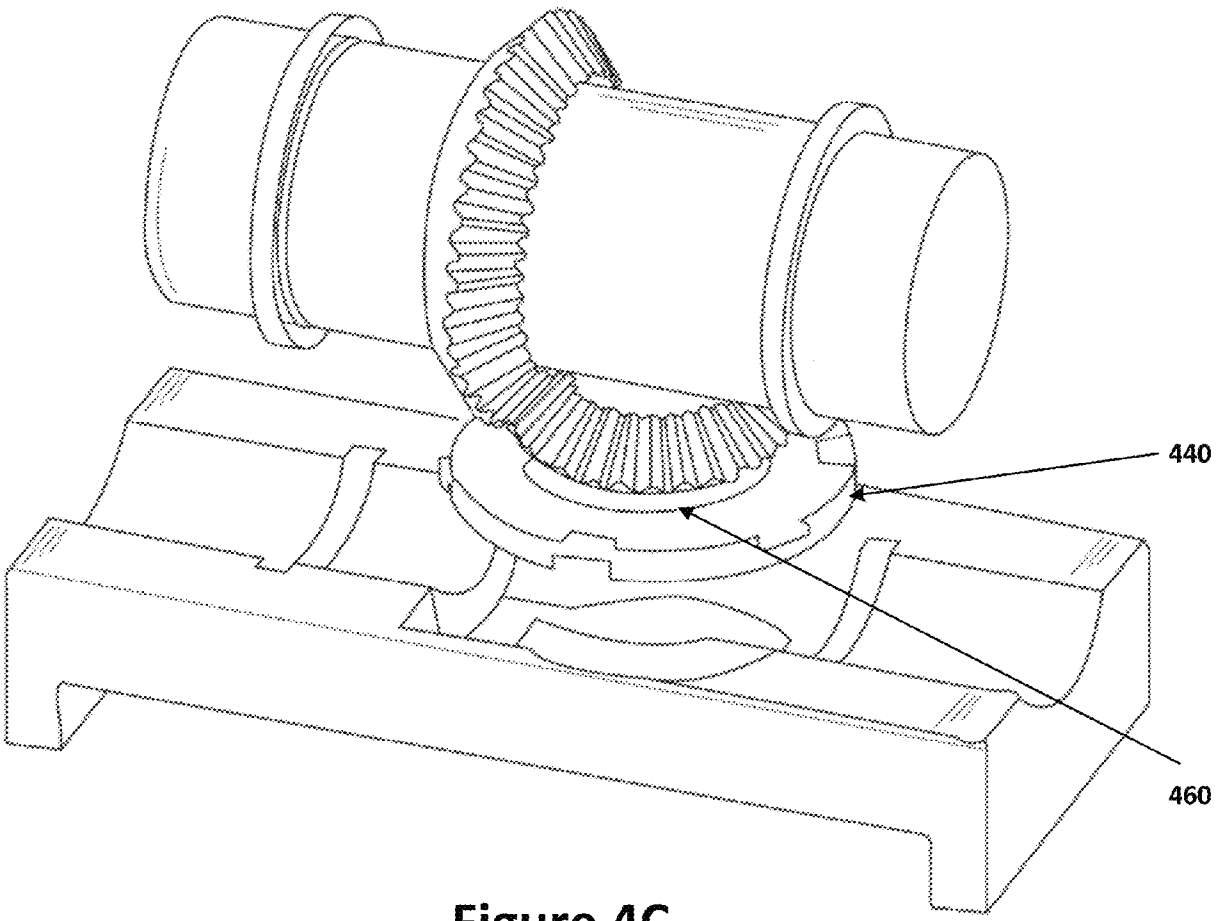
FIG. 4C is a perspective view of a rotary accessory with a container assembly in an elevated position in accordance with certain embodiments of the present invention.
Figure 4D:
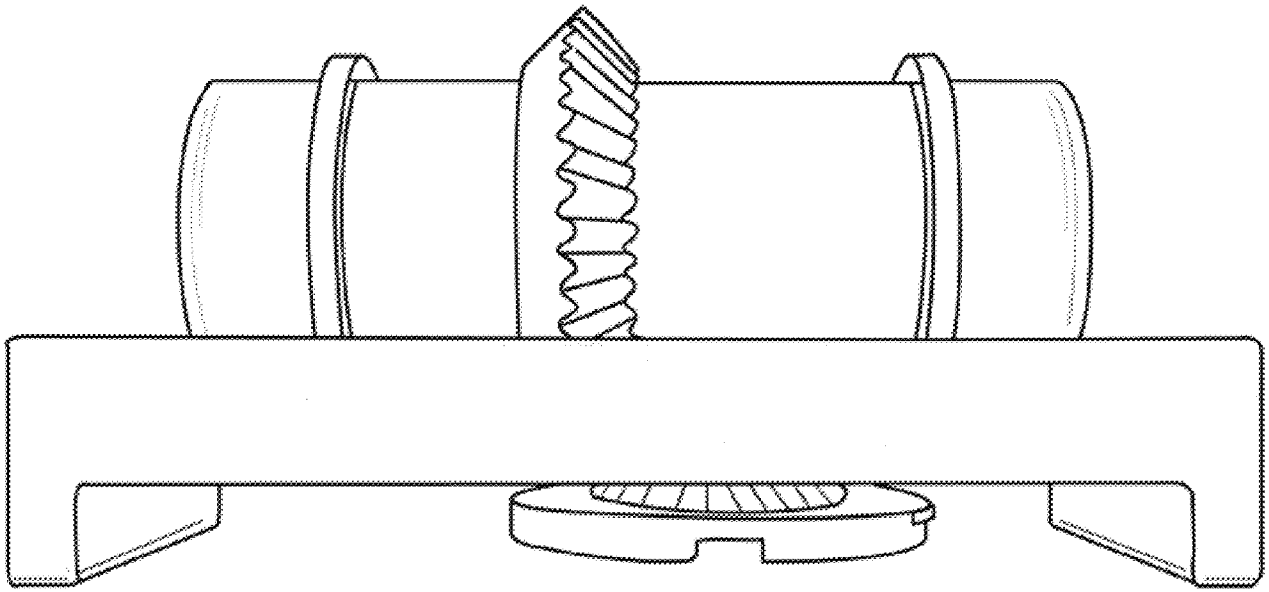
FIG. 4D is a side view of a rotary accessory in accordance with certain embodiments of the present invention.
Figure 4E:
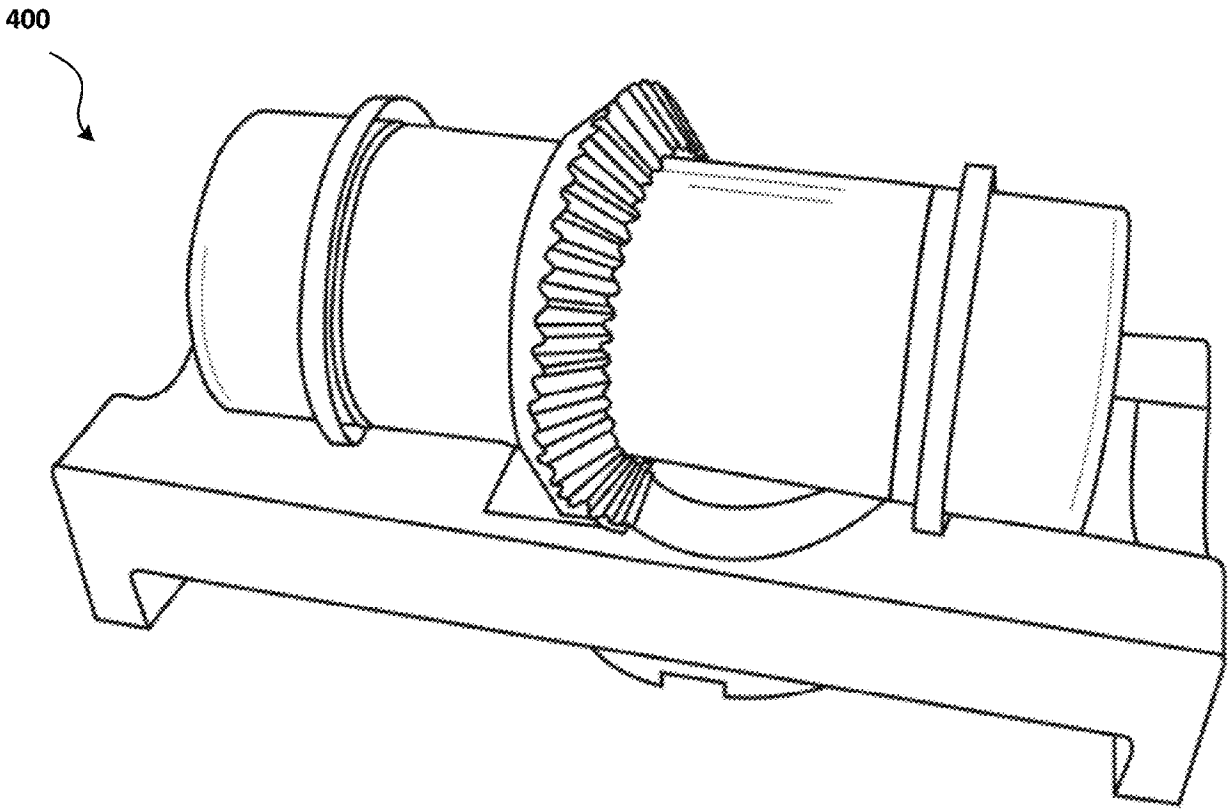
FIG. 4E is a perspective view of a rotary accessory in accordance with certain embodiments of the present invention.

As shown in the exploded view of FIG. 4B, the rotary device accessory 400 may be comprised of three primary components: a container assembly 430, a coupling portion 440, and a stand element 450. The coupling portion 440 is configured to be inserted into the opening 175 in the microwave tray 100 and to couple the rotary device accessory 400 to the rotary coupling 50 located on the bottom surface 10 of the microwave oven. The bottom surface of the coupling portion 440 includes a coupling connector 125 that is configured to engage the rotary coupling 50 (see, e.g., FIG. 4F). The coupling connector 125 includes three raised notches as described above. Rotation of the rotary coupling 50 causes container assembly 430 to spin or rotate the contents included within the container assembly 430.

Any appropriate configuration may be utilized to facilitate the spinning or rotation of the container assembly 430A. In certain embodiments, a bevel gear or mitre gear configuration may be utilized to facilitate the spinning or rotation of the container assembly 430. For example, in certain embodiments, a first gear component 425A may be located on the upper surface of the coupling portion 440 (see, e.g., FIG. 4B). The first gear component 425A may be integrally formed (e.g., formed in a manner that is non-separable or formed together during the fabrication process) with the coupling portion 440 or attached to the coupling portion 340 in any appropriate manner (e.g., using an adhesive). The first gear component 425A may be substantially parallel to the upper surface of the coupling portion 440 and the bottom surface 10 of the microwave oven. A second gear component 425B may be integrated with or attached to the container assembly 430. The second gear component may be situated substantially perpendicular to the first gear component 425A and the bottom surface 10 of the microwave oven. The first and second gear components 425A, 425B may be coupled together such that the horizontal rotation of the first gear component 425A (e.g., horizontal with respect to the bottom microwave surface 10) causes the vertical rotation of the second gear component. In certain embodiments, the second gear component is integrally attached to, and surrounds, a center portion of the cylindrical container assembly 430. In other embodiments, the second gear component 425B may not be integral with the container assembly 430 (e.g., the component 425B may be situated and attached to the left or right end cap 410, or attached it other ways). In either case, the horizontal rotation of the first gear component 425A causes the vertical rotation of the second gear component 425B, and the vertical rotation of the second gear component 425B causes the container assembly 430 to rotate.

The container assembly 430 depicted in the figures is cylindrical in shape and includes two removable end caps 410. The end caps 410 may be removable to permit insertion of food or other contents within the container assembly 430. The end caps 410 are preferably reinserted into the end of the container assembly body prior to utilizing the rotary accessory 400 in the microwave oven.

As shown in the figures, the stand element 450 may include an upper surface that is configured to receive and support the container assembly 330 The upper surface of the stand element 450 is formed in any appropriate manner that accommodates the shape of the container assembly 330 and which permits the container assembly 330 to rotate as a result of the rotating motion caused by the gear configuration. The bottom surface of the stand element may include one or more feet or foot structures that are configured to support the stand element 450 on a flat surface, such as the upper surface of the microwave tray 100.

Figure 4F:
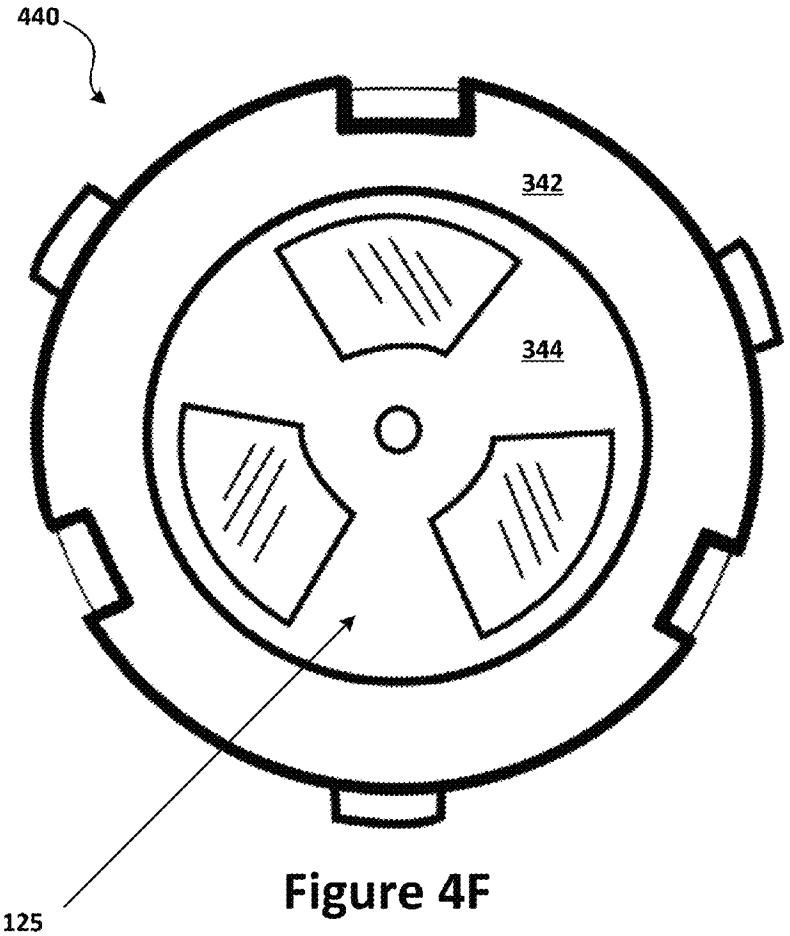
FIG. 4F is a bottom view of a coupling portion of a rotary accessory in accordance with certain embodiments of the present invention.

As shown in FIG. 4F, the bottom surface of the rotary device's coupling portion 440 is the same or substantially similar to the bottom surface of the coupling portion 340 included in the mixing bowl accessory 300. As would be understood by one of ordinary skill in the art, the same principles described above with respect to the coupling portion 340 of the mixing bowl accessory also apply to the coupling portion 440 of the rotary device accessory 400. For example, both coupling portions 340, 440 may include a similar configuration that includes an outer stationary surface 342 and an inner rotational surface 344 that is able to rotate freely with respect to the outer surface 342. However, in contrast to the coupling portion 340 of the mixing bowl accessory, the coupling portion 440 of the rotary device 400 causes the rotation of the first gear component 425A included on the upper surface of the coupling portion 440, which, in turn, causes the rotation of the second gear component 425B and container assembly 430.

The stand element 450 may include an opening that enables the first and second gear components to mate or engage one another. However, in other embodiments, the stand element 450 may be unnecessary. Instead, the coupling portion 440 may include arms or other structures that are able to support the container assembly 430. The arms or other structures may support the container assembly in a manner that is able to facilitate the connection between the first and second gear components 425A, 425B to cause rotation of the container assembly 430.

Other types of rotary device accessories may also be utilized in connection with the microwave tray. In certain embodiments, a rotary device accessory may be utilized which spins or rotates food without the use of the container assembly 430. For example, rather than placing food inside of the container assembly 430, a sleeve or other type of food packaging (e.g., such as the tubular sleeve that comes with Hot Pockets® offered by Nestle®) may be utilized to attach food items to the rotary device accessory. The rotary device may include an arm structure that extends horizontally with respect to the bottom surface 10 of the microwave oven. The arm structure may be attached to the first gear component and the food packaging, and it serves to spin or rotate the food included in the packaging. In other embodiments, food may be directly attached to the arm structure, or other components of the rotary device accessories, without using the food packaging.

One of ordinary skill in the art would recognize that numerous other variations can be made to the rotary device accessory 400 described herein without departing from the present principles.

V. Exemplary Methods, Embodiments and Features

Many other types of microwave accessories can be utilized in connection with the microwave tray described herein (aside from or in addition to the tray plug 150, mixing bowl accessory 300, and rotary device accessory 400). Some or all of the microwave accessories may include mating portions 120B that enable the microwave accessories to be mounted and secured to the microwave tray 100. Some or all of the microwave accessories may include coupling connectors 125 that enable the microwave accessories to be coupled to rotary couplings 50 located inside of microwave ovens. The microwave accessories may utilize the rotation of the rotary coupling 50 to perform a variety of different dynamic functions or may simply be coupled to the microwave tray 100 with no dynamic capabilities.

The microwave accessories may include cookware items that can be helpful for preparing food. Exemplary cookware accessories may include any of the following: popcorn poppers, air poppers, ramen cookers, omelet cookers, potato cookers, rice cookers, splatter guards, steamers, bacon racks or trays, egg boilers, casserole cookers or re-heaters, pressure cookers, pasta cookers, chip makers, macaroni and cheese cookers, nut roasters, microwave woks and sauce trays. Other exemplary accessories may include kitchenware items, such as plates, dishes, bowls, soup bowls, cups, coffee cups, teacups, mugs, etc. Generally speaking, any cookware or kitchenware item can be configured to be mounted on the microwave tray and to connect to the rotary coupling.

The inventive principles discussed herein may also be utilized in connection with non-cooking accessories, which can utilize the microwave for purposes other than cooking. Exemplary non-cooking accessories may include crayon makers, candle makers, clothing/fabric dyers or disinfecting devices (e.g., devices for disinfecting sponges, cutting boards and other items). Other types of accessories may also be utilized to perform functions related to heating towels (or other fabric based products), heating pads and gel packs, softening sugar, warming beauty products (e.g., mascara), and sterilizing garden soil. Once again, any of the aforementioned accessories may include mating portions 120B that are configured to engage mating portions 120B of the microwave trays and/or coupling connectors 125 configured to engage the rotary couplings 50 in microwave ovens.

Figure 5:
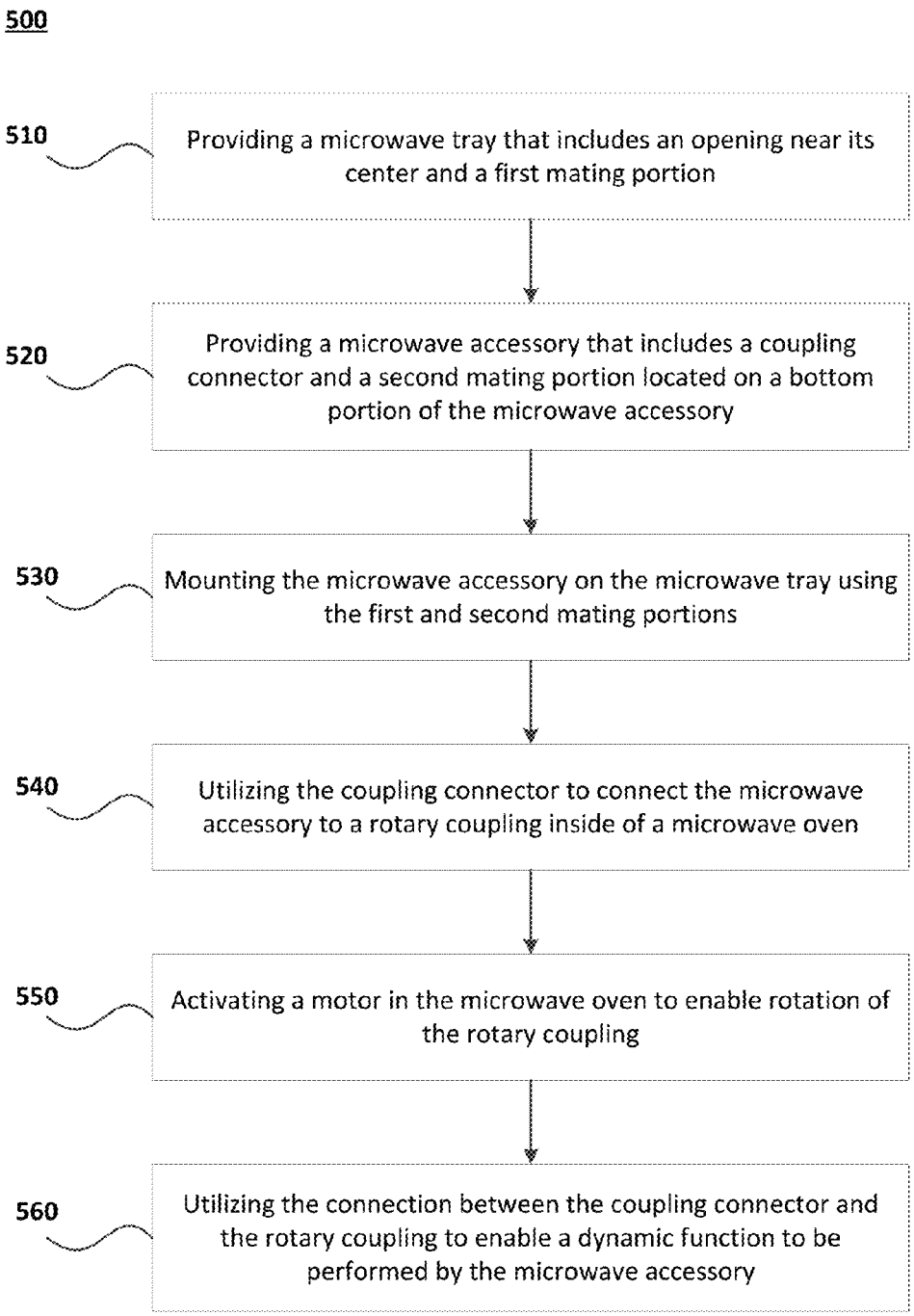
FIG. 5 is a flow diagram of an exemplary method for utilizing a microwave tray and microwave accessory.

FIG. 5 is a flow diagram of an exemplary method 500 for utilizing a microwave tray 100 and microwave accessory. A microwave tray 100 is provided that includes an opening near its center and a first mating portion 120A (step 510). A microwave accessory (e.g., such as the mixing bowl accessory 300, rotary device accessory 400, or other accessory) is provided that includes a coupling connector 125 and a second mating portion 120B located on a bottom portion of the microwave accessory (step 520). A microwave accessory is mounted on the microwave tray 100 using the first and second mating portions (step 530). Any type of mating mechanism may be utilized to secure the microwave accessory to the tray 100. The coupling connector 125 may be utilized to connect the microwave accessory to a rotary coupling 50 of a microwave oven (step 540). The rotary coupling 50 may be formed in any shape or configuration and the coupling connector 125 can be varied appropriately to engage the rotary coupling. A motor in the microwave oven Is activated to enable rotation of the rotary coupling (step 550). The motor may be activated when the microwave is powered on and/or when the microwave is emitting radiation to heat food or other contents included in the microwave oven. The connection between the coupling connector 50 and the rotary coupling 125 enables a dynamic function (e.g., stirring, mixing, rotating or flipping) to be performed by the microwave accessory (step 560).

The microwave tray 100 and microwave accessories described in this disclosure can be manufactured using any suitable technique. Exemplary techniques that may be utilized to manufacture the tray 100 and accessories include, but are not limited to, molding techniques (e.g., blow molding, injection molding or compression molding techniques), casting techniques (e.g., in which liquid material is poured into a mold), 3D-printing or additive manufacturing techniques, and machining techniques (e.g., in which a piece of material that is cut into a desired final shape and size).

Figure 6:
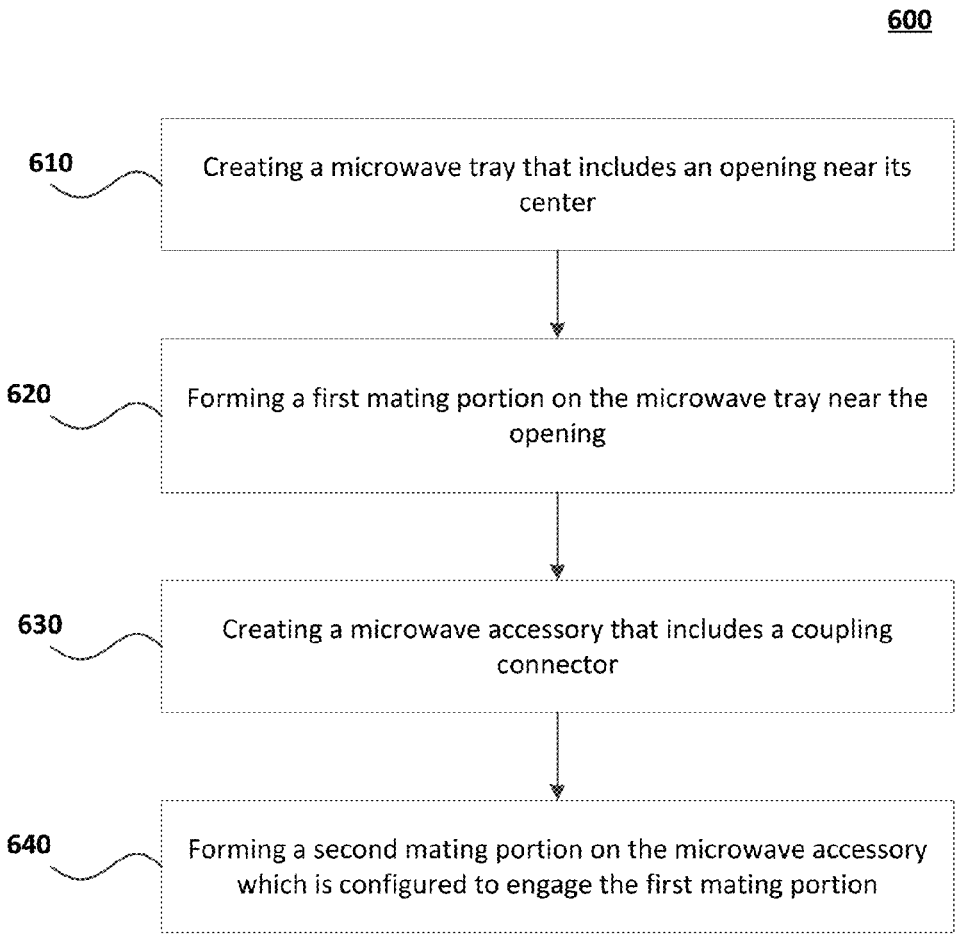
FIG. 6 is a flow diagram of an exemplary method for fabricating a microwave tray and a microwave accessory.

FIG. 6 is a flow diagram of an exemplary method for fabricating a microwave tray 100 and/or a microwave accessory. A microwave tray 100 is created that includes an opening 175 near its center (step 610). The tray may be created using any of the aforementioned fabrication techniques or other fabrication techniques. A first mating portion 120A is formed on the microwave tray near its opening 175 (step 620). The step of forming the first mating portion may be performed simultaneously with the step of creating a microwave tray or may be performed as a separate step. A microwave accessory is created that includes a coupling connector 125 (step 630). The coupling connector 125 can be can be formed to accommodate the shape of any rotary coupling 125 for any microwave oven (e.g., such as a three-pronged or triangular rotary coupling shown in the figures or rotary couplings having other configurations).

A microwave accessory may be created using any of the aforementioned fabrication techniques or other fabrication techniques. The microwave accessory may include any of the exemplary microwave accessories mentioned in this disclosure or other microwave accessories. A second mating portion 120B is formed into the microwave accessory which is configured to engage the first mating portion 120A (step 650). In certain embodiments, the step of forming the second mating portion 120B may be performed simultaneously with the step of creating a microwave accessory. The microwave accessory can be mounted and secured to the microwave tray 100 through a connection formed between the first and second microwave mating portions 120A, 120B.

In certain embodiments, the microwave accessories can be utilized without the microwave tray 100. For example, the microwave accessories can be coupled directly to the rotary coupling in the microwave oven without requiring the microwave tray 100. In such embodiments, the microwave accessories may include feet or other structures for supporting the accessories on the bottom surface of the microwave ovens.

In certain embodiments, the microwave tray 100 is able to spin or rotate while the mixing bowl accessory 300, rotary accessory 400 and other microwave accessories are mounted on the microwave tray 100. Thus, while the microwave accessories are performing dynamic functions, the microwave tray 100 may also be rotating.

The embodiments described in this disclosure can be combined in any manner. Any aspect or feature that is described for one embodiment can be incorporated into any other embodiment mentioned in this disclosure.

While there have been shown and described and pointed out various novel features of the invention as applied to particular embodiments thereof, it will be understood that various omissions and substitutions and changes in the form and details of the apparatuses, systems and methods described and illustrated, may be made by those skilled in the art without departing from the spirit of the invention. Amongst other things, the steps shown in the methods may be carried out in different orders in many cases where such may be appropriate. Those skilled in the art will recognize, based on the above disclosure and an understanding therefrom of the teachings of the invention, that the particular hardware and devices that are part of the system described herein, and the general functionality provided by and incorporated therein, may vary in different embodiments of the invention. Accordingly, the particular system components shown in the figures are for illustrative purposes to facilitate a full and complete understanding and appreciation of the various aspects and functionality of particular embodiments of the invention as realized in system and method embodiments thereof. Those skilled in the art will appreciate that the invention can be practiced in other than the described embodiments, which are presented for purposes of illustration and not limitation.

What is claimed is:

1. A microwave assembly for use in a microwave oven, the microwave assembly comprising:

a microwave tray that has an opening located near its center; and a microwave accessory that comprises (i) a structure which includes a container or receptacle for holding contents to be heated in the microwave oven, and (ii) a bottom surface that includes a coupling connector that is configured to engage a rotary coupling located on an interior floor of a microwave oven;

wherein the rotary coupling is located directly on, and extends through, the interior floor of the microwave oven, and wherein the coupling connector located on the bottom surface of the microwave accessory is configured to connect a top portion of the rotary coupling that protrudes upward from the interior floor.

2. The microwave assembly of claim 1, wherein the microwave assembly further includes a second microwave accessory that is a tray plug accessory and insertion of the tray plug accessory into the opening enables the microwave tray to rotate when the microwave oven is powered on.

3. The microwave assembly of claim 2, wherein the tray plug accessory has a flat upper surface and insertion of the tray plug accessory into the opening creates a substantially flat surface for the microwave tray.

4. The microwave assembly of claim 1, wherein the container or receptacle of the microwave accessory includes or is connected to an assembly that is configured to stir, mix, rotate or flip contents included within the container or receptacle.

5. The microwave assembly of claim 4, wherein the connection between the coupling connector and the rotary coupling enables the microwave accessory to stir, mix, rotate or flip the contents included in the microwave accessory.

6. The microwave assembly of claim 1, wherein the coupling connector located on the bottom surface of the microwave accessory includes one or more indentations or recesses, and the one or more indentations or recesses are configured to receive and engage a three-pronged or triangular-shaped rotary coupling located on the interior floor of the microwave oven.

7. The microwave assembly of claim 1, wherein the microwave accessory is a mixing bowl accessory and the microwave accessory further comprises:

a mixing assembly comprising one or more mixing blades, the mixing assembly being configured to stir or mix contents included in the mixing bowl accessory in response to rotation of the rotary coupling when the coupling connector is engaged with the rotary coupling.

8. The microwave assembly of claim 1, wherein the microwave accessory is a rotary device and the microwave accessory further comprises:

a container assembly for holding contents to be heated in the microwave oven, the container assembly being configured to rotate or flip contents included in the container assembly in response to rotation of the rotary coupling when the coupling connector is engaged with the rotary coupling.

9. The microwave assembly of claim 8, wherein the non-cooking accessory is selected from the group consisting of: a crayon maker, a candle maker, a fabric dyer, and a disinfecting device.

10. The microwave assembly of claim 1, wherein the microwave accessory is a non-cooking accessory that performs a function related to heating non-food contents.

11. The microwave assembly of claim 1, wherein the microwave accessory has a decoupled structure that includes:

a mobile portion of the microwave accessory which is configured to rotate freely when the coupling connector is attached to the rotary coupling and the rotary coupling is rotating; and a stationary portion of the microwave accessory which is configured to remain stationary when the coupling connector is attached to the rotary coupling and the rotary coupling is rotating.

12. A microwave assembly comprising:

a microwave tray that has an opening located near its center;

a rotary coupling located on a floor included within the microwave oven; and a microwave accessory including (i) a structure for holding contents to be heated in the microwave oven, and (ii) a bottom surface that includes a coupling connector that enables the microwave accessory to be attached to the rotary coupling located on the floor;

wherein the rotary coupling is integrated into the floor of the microwave oven;

wherein a top portion of the rotary coupling is raised above the floor; and wherein the coupling connector and the top portion of the rotary coupling include corresponding mating structures which permit the microwave accessory to be attached to the rotary coupling through the opening in the microwave tray.

13. The microwave assembly of claim 12, wherein the microwave assembly further includes a tray plug that is configured to be inserted into the opening, and the microwave tray includes a first mating connector and the tray plug includes a second mating connector, the first mating connector and second mating connector being configured to secure the tray plug to the microwave tray.

14. The microwave assembly of claim 13, wherein the microwave accessory has a decoupled structure that includes:

a mobile portion of the microwave accessory which is configured to rotate freely when the coupling connector is attached to the rotary coupling and the rotary coupling is rotating; and a stationary portion of the microwave accessory which is configured to remain stationary when the coupling connector is attached to the rotary coupling and the rotary coupling is rotating.

15. The microwave assembly of claim 12, wherein the microwave assembly further includes a tray plug that is configured to be inserted into the opening, and a top surface of the tray plug is substantially flat and a top surface of the microwave tray is substantially flat, and wherein insertion of the tray plug into the opening creates a substantially flat and substantially continuous upper surface for the microwave tray.

16. The microwave assembly of claim 12, wherein the microwave assembly further includes a tray plug that is configured to be inserted into the opening, and a second coupling connector located on a bottom surface of the tray plug is configured to connect the tray plug to the rotary coupling and rotation of the rotary coupling causes the microwave tray to rotate.

17. The microwave assembly of claim 12, wherein the microwave accessory is configured to be mounted on the microwave tray near the opening in the microwave tray.

18. The microwave assembly of claim 17, wherein the microwave accessory includes an assembly that is configured to stir, mix, rotate or flip contents included in the microwave accessory; and wherein a connection between the second coupling connector and the rotary coupling enables the microwave accessory to stir, mix, rotate or flip the contents included in the microwave accessory in response to rotation of the rotary coupling.

* * * * *